US011121476B2

(12) United States Patent
Kim et al.

(10) Patent No.: US 11,121,476 B2
(45) Date of Patent: Sep. 14, 2021

(54) CHIP ANTENNA MODULE

(71) Applicant: Samsung Electro-Mechanics Co., Ltd., Suwon-si (KR)

(72) Inventors: Jae Yeong Kim, Suwon-si (KR); Sung Nam Cho, Suwon-si (KR); Ju Hyoung Park, Suwon-si (KR); Jeong Ki Ryoo, Suwon-si (KR); Kyu Bum Han, Suwon-si (KR); Sung Yong An, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 23 days.

(21) Appl. No.: 16/725,377

(22) Filed: Dec. 23, 2019

(65) Prior Publication Data

US 2020/0259269 A1 Aug. 13, 2020

(30) Foreign Application Priority Data

Feb. 8, 2019 (KR) ..... 10-2019-0015000
Jul. 5, 2019 (KR) ..... 10-2019-0081510

(51) Int. Cl.
*H01Q 21/06* (2006.01)
*H01Q 19/10* (2006.01)
(Continued)

(52) U.S. Cl.
CPC ..... *H01Q 21/065* (2013.01); *H01Q 1/2283* (2013.01); *H01Q 1/48* (2013.01); *H01Q 19/10* (2013.01)

(58) Field of Classification Search
CPC ..... H01Q 21/065; H01Q 19/10; H01Q 1/48; H01Q 1/2283; H01Q 21/28; H01Q 9/0414;
(Continued)

(56) References Cited

U.S. PATENT DOCUMENTS 7,928,897 B2 * 4/2011 Ishii ..... G01S 13/46 342/105
10,944,181 B2 3/2021 Takayama et al.
(Continued)

FOREIGN PATENT DOCUMENTS

JP 2003-283239 A 10/2003
KR 10-2010-0059257 A 6/2010
(Continued)

OTHER PUBLICATIONS

Korean Office Action dated Jan. 14, 2020 in counterpart Korean Patent Application No. 10-2019-0081510 (6 pages in English and 5 pages in Korean).
(Continued)

*Primary Examiner* — Daniel D Chang
(74) *Attorney, Agent, or Firm* — NSIP Law

(57) ABSTRACT

A chip antenna module includes a substrate, a plurality of chip antennas disposed on a first surface of the substrate, and an electronic element mounted on a second surface of the substrate, wherein each of the plurality of chip antennas includes a first ceramic substrate mounted on the first surface of the substrate, a second ceramic substrate opposing the first ceramic substrate, a first patch disposed on the first ceramic substrate, and a second patch disposed on the second ceramic substrate, and the first ceramic substrate and the second ceramic substrate are spaced apart from each other.

21 Claims, 20 Drawing Sheets

(51) Int. Cl.
*H01Q 1/48* (2006.01)
*H01Q 1/22* (2006.01)

(58) Field of Classification Search
CPC ..... H01Q 19/24; H01Q 1/521; H01Q 1/38; H01Q 1/50; H01Q 21/0006; H01Q 21/08
See application file for complete search history.

(56) References Cited

U.S. PATENT DOCUMENTS

| | | | | |
|---|---|---|---|---|
| 2008/0316106 | A1* | 12/2008 | Voigtlaender ..... | H01Q 1/2283 343/700 MS |
| 2009/0224960 | A1 | 9/2009 | Ishii et al. | |
| 2014/0145883 | A1 | 5/2014 | Baks et al. | |
| 2019/0027804 | A1* | 1/2019 | Kim ..... | H01Q 21/0025 |
| 2020/0119453 | A1* | 4/2020 | Takayama ..... | H01Q 9/0421 |
| 2020/0161766 | A1 | 5/2020 | Liu et al. | |

FOREIGN PATENT DOCUMENTS

| | | | |
|---|---|---|---|
| KR | 10-1489577 | B1 | 2/2015 |
| KR | 10-2019-0009232 | A | 1/2019 |
| WO | WO 2008/053685 | A1 | 5/2008 |
| WO | WO 2018/210054 | A1 | 11/2018 |
| WO | WO 2018/230475 | A1 | 12/2018 |

OTHER PUBLICATIONS

Japanese Office Action dated Jan. 12, 2021, in counterpart Japanese Patent Application No. 2019-230305 (6 pages in English and 3 pages in Japanese).

* cited by examiner

CHIP ANTENNA MODULE

CROSS-REFERENCE TO RELATED APPLICATIONS

This application claims the benefit under 35 USC 119(a) of Korean Patent Application Nos. 10-2019-0015000 filed on Feb. 8, 2019, and 10-2019-0081510 filed on Jul. 5, 2019, in the Korean Intellectual Property Office, the entire disclosures of which are incorporated herein by reference for all purposes.

BACKGROUND

1. Field

This application relates to a chip antenna module.

2. Description of Related Art

A 5G communications system is implemented in high frequency bands (mmWave bands), between 10 Ghz and 100 GHz, for example, to obtain a high data transfer rate. To reduce signal loss increase a transmission distance, techniques such as beamforming, large-scale multiple-input multiple-output (MIMO), full-dimensional multiple-input multiple-output (FD-MIMO), an antenna array, analog beamforming, and other large-scale antenna techniques have been considered for use in a 5G communications system.

Mobile communication terminals, such as mobile phones, PDAs, navigation devices, laptops, other portable devices supporting wireless communications, have been designed to include functionality such as CDMA, wireless LAN, digital multimedia broadcasting (DMB), and near-field communication (NFC), and one of main components that enables such functionality is an antenna.

It is difficult to use an antenna that is typically used in mobile communication terminal in the GHz bands used in a 5G communications system because wavelengths are as small as several millimeters in the 5G GHz bands.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a chip antenna module includes a substrate; a plurality of chip antennas disposed on a first surface of the substrate; and an electronic element mounted on a second surface of the substrate, wherein each of the plurality of chip antennas includes a first ceramic substrate mounted on the first surface of the substrate, a second ceramic substrate opposing the first ceramic substrate, a first patch disposed on the first ceramic substrate, and a second patch disposed on the second ceramic substrate, and the first ceramic substrate and the second ceramic substrate are spaced apart from each other.

The chip antenna module may further include a spacer disposed between the first ceramic substrate and the second ceramic substrate to space the first ceramic substrate and the second ceramic substrate apart from each other.

The chip antenna module may further include a bonding layer disposed between the first ceramic substrate and the second ceramic substrate to space the first ceramic substrate and the second ceramic substrate apart from each other.

Each of the plurality of chip antennas may have a width extending in a first direction and a length extending in a second direction perpendicular to the first direction, the plurality of chip antennas may be arranged in the second direction, and side surfaces extending in the first direction of two chip antennas adjacent to each other in the second direction among the plurality of chip antennas may oppose each other in the second direction.

The plurality of chip antennas may be further arranged in the second direction, and side surfaces extending in the second direction of two chip antennas adjacent to each other in the first direction among the plurality of chip antennas may oppose each other in the first direction.

Each of the plurality of chip antennas may configured to transmit and receive a radio-frequency signal having a wavelength $\lambda$, and a spacing distance between centers of two chip antennas adjacent to each other among the plurality of chip antennas may be less than $\lambda/2$.

Each of the plurality of chip antennas may be configured to transmit a radio-frequency signal, and the substrate may include a ground layer configured to reflect the radio-frequency signal transmitted by each of the plurality of chip antennas in a target direction.

The ground layer may be disposed on the first surface of the substrate.

The substrate further nay include a plurality of feed pads disposed on the first surface of the substrate; and a plurality of upper surface pads disposed on the first surface of the substrate, the plurality of chip antennas may be electrically connected to respective ones of the plurality of feed pads, and are bonded to respective ones of the plurality of upper surface pads, and the ground layer may be disposed in a region of the upper surface of the substrate other than regions of the upper surface of the substrate in which the plurality of feed pads and the plurality of upper surface pads are disposed.

In another general aspect, a chip antenna module includes a substrate including a plurality of layers including a first external layer disposed on a first surface of the substrate, a second external layer disposed on a second surface of the substrate, at least one internal layer disposed between the first external layer and the second external layer; and a plurality of chip antennas disposed on the first surface of the substrate in an array, wherein each of the plurality of chip antennas is configured to transmit a radio-frequency (RF) signal and includes a first ceramic substrate mounted on the first surface of the substrate, a second ceramic substrate opposing the first ceramic substrate, a first patch disposed on the first ceramic substrate, and a second patch disposed on the second ceramic substrate, and the first external layer or one of the internal layers is a ground layer a configured to reflect the RF signal transmitted by each of the plurality of chip antennas in a target direction.

The substrate may further include a ground via connected to the ground layer, and the ground via may extend to the first surface of the substrate from the ground layer.

The ground via may be disposed between adjacent chip antennas of the plurality of chip antennas.

The ground via may be disposed equidistant from each of the adjacent chip antennas.

The substrate may further include a plurality of ground vias connected to the ground layer, and the plurality of ground vias may extend to the first surface of the substrate from the ground layer.

The plurality of ground vias may be disposed between opposing side surfaces of adjacent chip antennas of the plurality of chip antennas.

The substrate may further include a shielding wall protruding from the first surface of the substrate between adjacent chip antennas of the plurality of chip antenna.

The substrate may further include a ground via connected to the ground layer, and the ground via may extend from the ground layer into the shielding wall.

In another general aspect, a chip antenna module includes a substrate; a chip-type patch antenna spaced apart from an upper surface of the substrate and configured to transmit a radio-frequency (RF) signal in a first direction perpendicular to the upper surface of the substrate; and a chip-type end-fire antenna disposed in the substrate and configured to transmit an RF signal in a second direction parallel to the upper surface of the substrate, wherein the chip-type patch antenna include a first ceramic substrate spaced apart from the upper surface of the substrate; a first patch disposed on an upper surface of the first ceramic substrate; a second ceramic substrate spaced apart from the upper surface of the first ceramic substrate, and a second patch disposed on an upper surface of the second substrate or a lower surface of the second ceramic substrate.

The second patch may be disposed on the lower surface of the second ceramic substrate, and the chip-type patch antenna further includes a third patch disposed on the upper surface of the second ceramic substrate, or the second patch may be disposed on the upper surface of the second ceramic substrate.

The substrate may include an upper surface pad disposed on the upper surface of the substrate, and the chip-type patch antenna may further include a bonding pad disposed on a lower surface of the first ceramic substrate and bonded to an upper surface of the upper surface pad; and any one of a spacer disposed on a corner of the upper surface of the first ceramic substrate and contacting a corner of the lower surface of the second ceramic substrate, a bonding layer disposed on the upper surface of the first ceramic substrate and an upper surface of the first patch, and contacting the lower surface of the second ceramic substrate, and a conductive paste or a conductive epoxy disposed on the upper surface of the first ceramic substrate and the upper surface of the first patch, and contacting the lower surface of the second ceramic substrate.

The chip-type end-fire antenna may include a ground portion made of a conductive material; a body portion made of a dielectric material and disposed on a surface of the ground portion facing in the second direction; and a radiation portion made of a conductive material and disposed on a surface of the body portion facing in the second direction.

In another general aspect, a chip antenna module includes a substrate; a chip-type patch antenna spaced apart from an upper surface of the substrate and configured to transmit a radio-frequency (RF) signal in a first direction perpendicular to the upper surface of the substrate; and a chip-type end-fire antenna disposed in the substrate and configured to transmit an RF signal in a second direction parallel to the upper surface of the substrate, wherein the substrate includes a ground layer configured to reflect the RF signal transmitted by the chip-type patch antenna in the first direction.

The ground layer may be disposed on the upper surface of the substrate, or may be disposed inside the substrate.

The ground layer may be disposed inside the substrate, and the substrate may further include a second ground layer disposed on the upper surface of the substrate and configured to reflect the RF signal transmitted by the chip-type patch antenna in the first direction.

The chip-type patch antenna may include a first ceramic substrate spaced apart from the upper surface of the substrate; a first patch disposed on an upper surface of the first ceramic substrate; a second ceramic substrate spaced apart from the upper surface of the first ceramic substrate, and a second patch disposed on an upper surface of the second substrate or a lower surface of the second ceramic substrate, and the chip-type end-fire antenna may include a ground portion made of a conductive material; a body portion made of a dielectric material and disposed on a surface of the ground portion facing in the second direction; and a radiation portion made of a conductive material and disposed on a surface of the body portion facing in the second direction.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
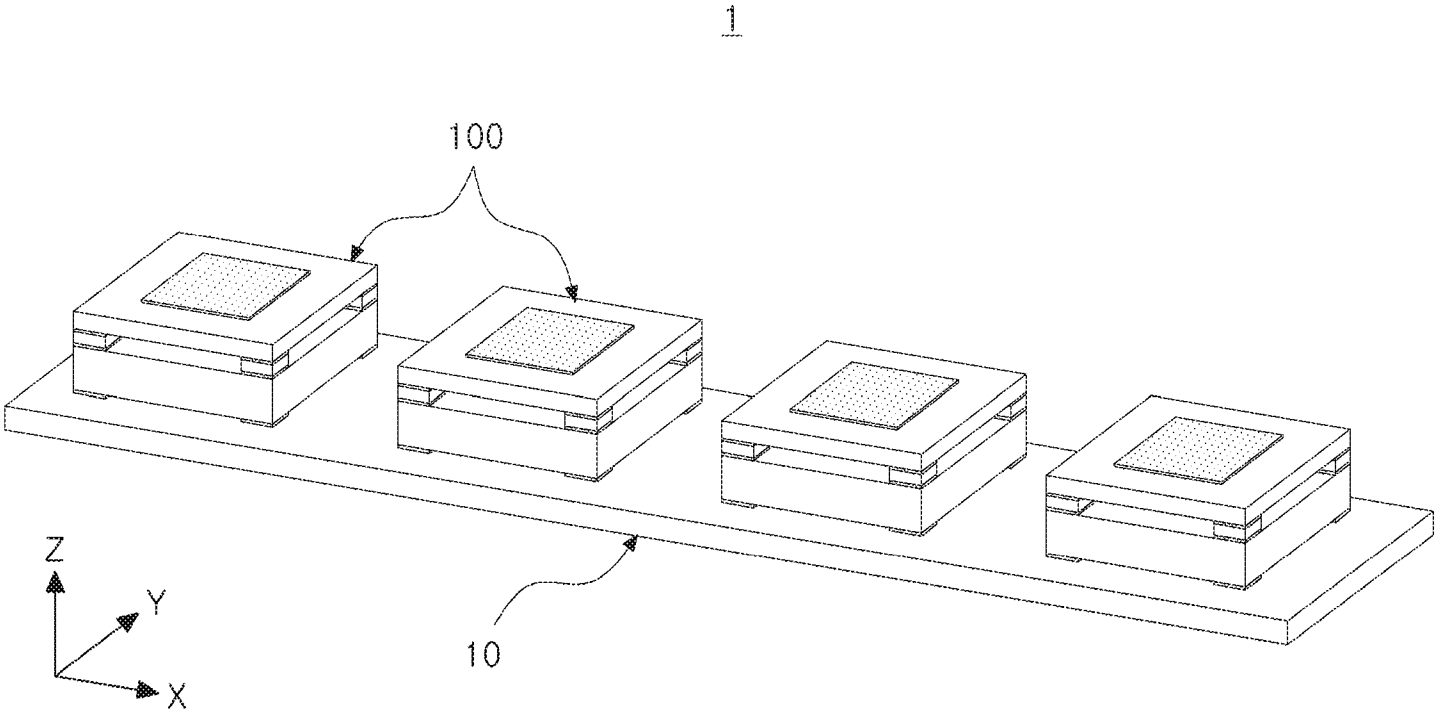
FIG. 1 is a perspective diagram illustrating an example of a chip antenna module.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated by 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

The chip antenna module in the examples described in this application may operate in a radio-frequency (RF) range, for example, in a frequency band of 3 GHz or higher, or in a band of 20 GHz to 40 GHz. The chip antenna module in the in the examples described in this application may be mounted in an electronic device configured to receive, or to receive and transmit, an RF signal. For example, the chip antenna module may be mounted in a portable phone, a portable laptop, or a drone.

Figure 2A:
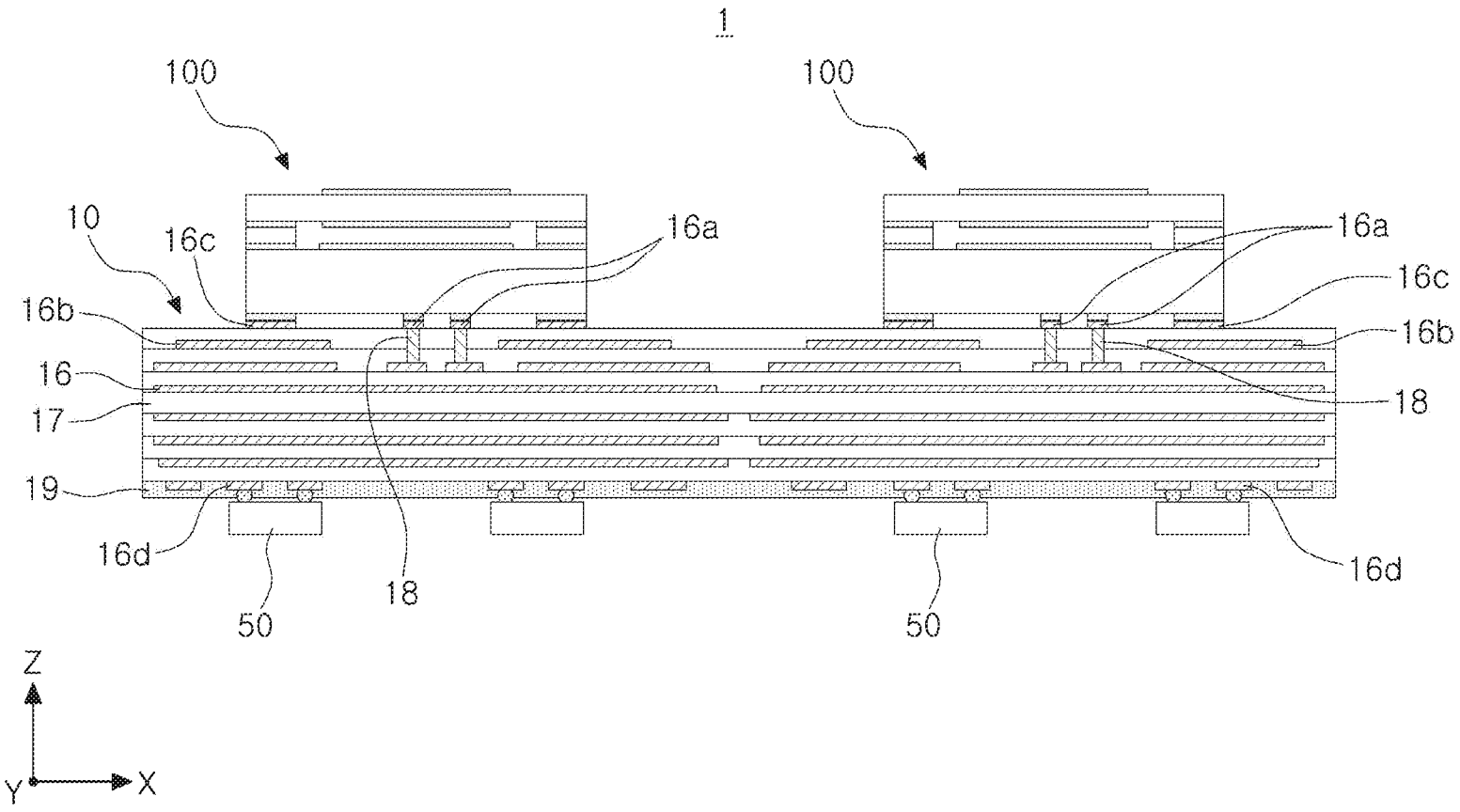
FIG. 2A is a cross-sectional diagram illustrating a portion of the chip antenna module illustrated in FIG. 1.
Figure 3A:
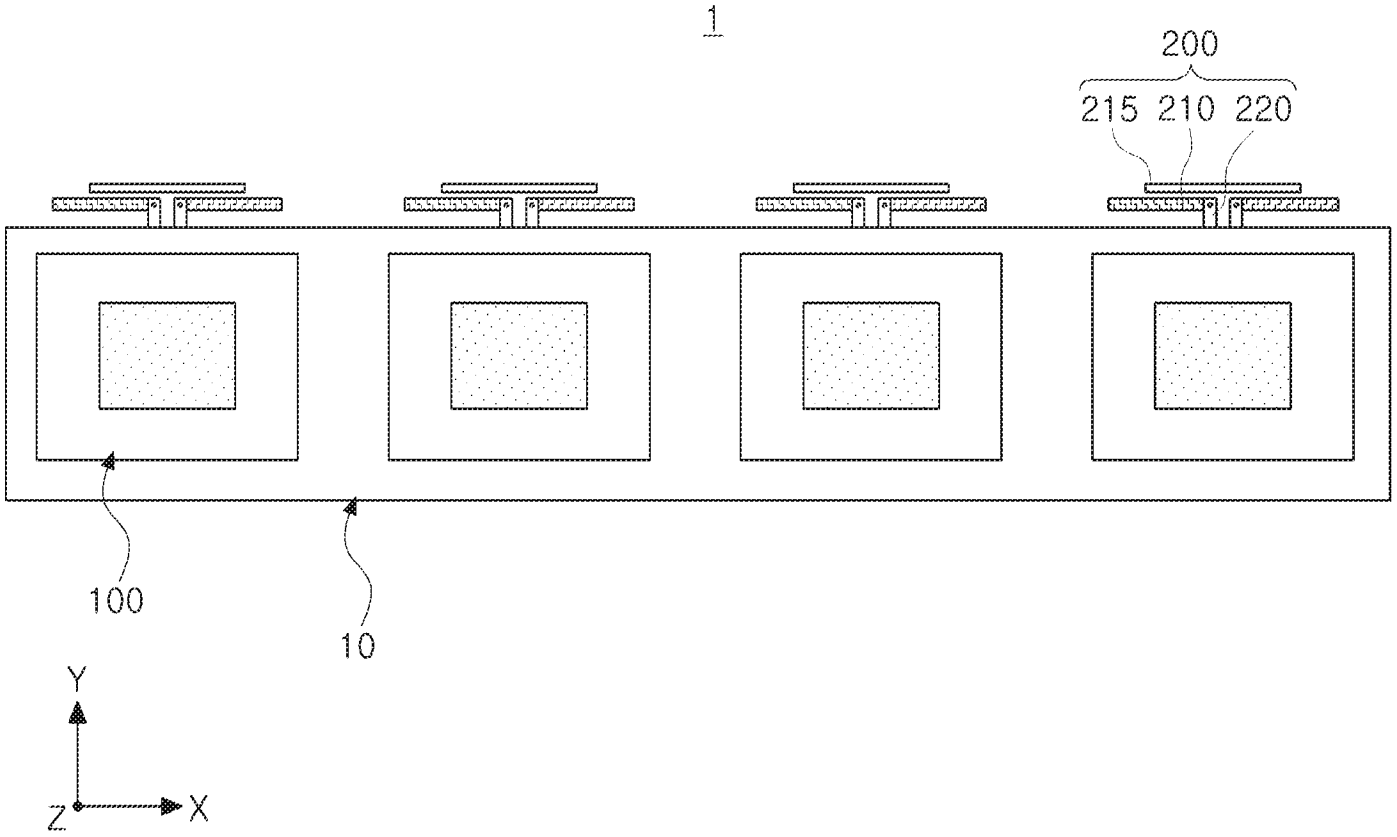
FIG. 3A is a plan diagram illustrating the chip antenna module illustrated in FIG. 1.
Figure 3B:
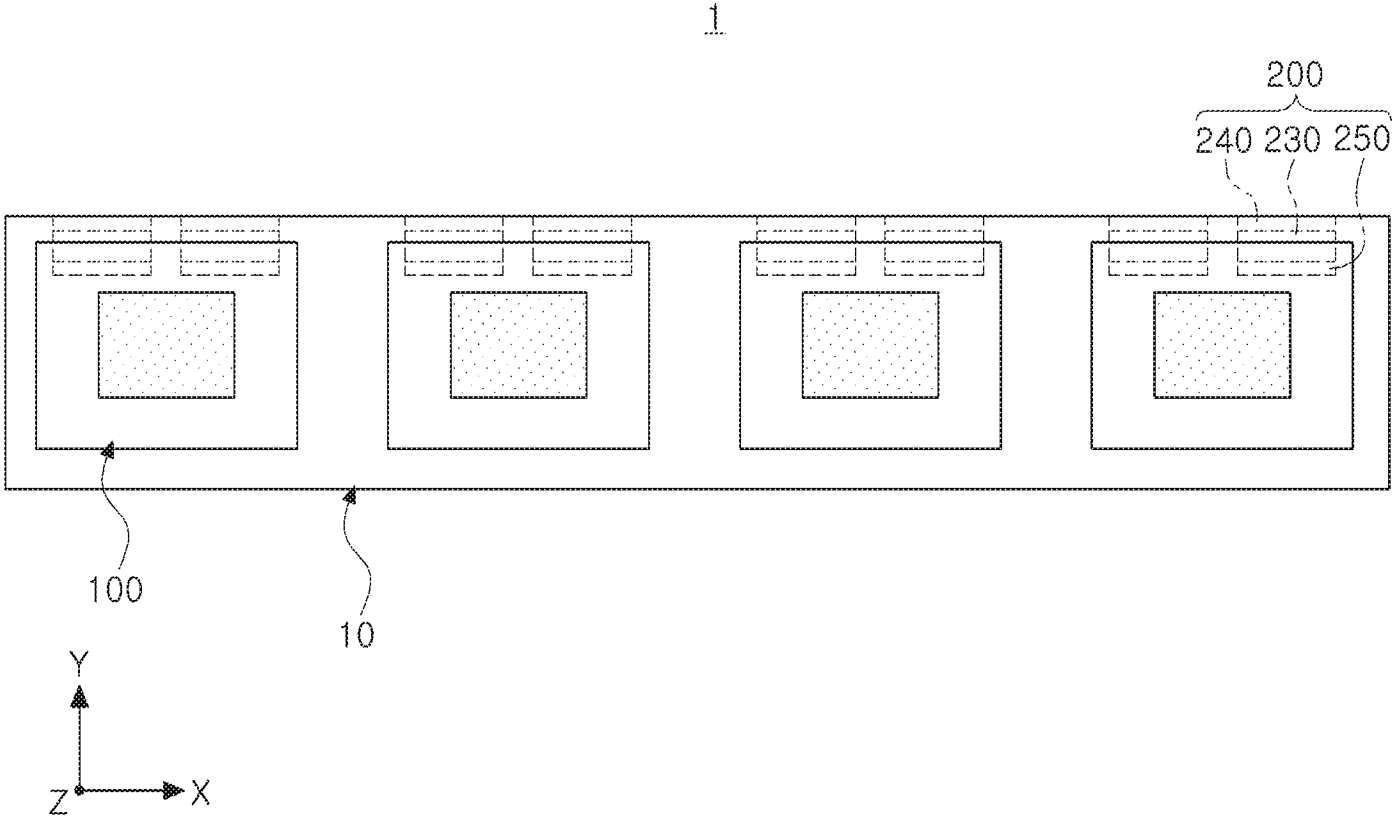
FIG. 3B is a plan diagram illustrating a modified example of the chip antenna module illustrated in FIG. 3A.

FIG. 1 is a perspective diagram illustrating an example of a chip antenna module. FIG. 2A is a cross-sectional diagram illustrating a portion of the chip antenna module illustrated in FIG. 1. FIG. 3A is a plan diagram illustrating the chip antenna module illustrated in FIG. 1. FIG. 3B is a plan diagram illustrating a modified example of the chip antenna module illustrated in FIG. 3A.

Referring to FIGS. 1, 2A, and 3A, a chip antenna module 1 includes a substrate 10, a plurality of electronic elements 50, a plurality of chip antennas 100, and a plurality of end-fire antennas 200. The electronic elements 50, the chip antennas 100, and the end-fire antennas 200 are disposed on the substrate 10.

The substrate 10 is a circuit substrate including circuit wiring lines and having a surface on which the electronic components 50, which are needed to operate the chip antennas 100, are mounted. For example, the substrate 10 may be a printed circuit board (PCB) having a surface on which the electronic components 50 are mounted, and including circuit wiring lines electrically connecting the electronic components 50 to one another. The substrate 10 may be a flexible substrate, a ceramic substrate, a glass substrate, or any other type of substrate.

The substrate 10 includes a plurality of layers. For example, the substrate 10 may be a multilayer substrate formed by alternately layering a plurality of insulating layers 17 and a plurality of wiring layers 16. The wiring layers 16 include an upper external wiring layer disposed on an upper surface of the substrate 10, a lower external wiring layer disposed on a lower surface of the substrate 10, and internal wiring layers disposed between the upper external wiring layer and the lower external wiring layer.

For example, the insulating layers 17 may be made of an insulating material such as a prepreg, an Ajinomoto Build-up Film, (ABF), FR-4, or bismaleimide triazine (BT), or any other insulating material suitable for making the insulating layers 17. The insulating material may be made of a thermosetting resin such as an epoxy resin, a thermoplastic resin such as a polyimide resin, a resin such as the thermosetting resin or the thermoplastic resin impregnated together with an inorganic filler into a core material such as glass fibers, a glass cloth, or a glass fabric. In other examples, the insulating layers 17 may be made of a photosensitive insulating resin.

The wiring layers 16 electrically connect the electronic elements 50, the chip antennas 100, and the end-fire antennas 200 to one another. The wiring layers 16 also electrically connect the electronic elements 50, the chip antennas 100, and the end-fire antennas 200 to an external device.

The wiring layers 16 are made of a conductive material such as copper (Cu), aluminum (Al), silver (Ag), tin (Sn), gold (Au), nickel (Ni), lead (Pb), or titanium (Ti), or an alloy of any two or more thereof.

A plurality of wiring vias 18 interconnecting the wiring layers 16 are formed in the insulating layers 17.

The chip antennas 100 are mounted on the upper surface of the substrate 10. The chip antennas 100 have a width extending in a Y axis direction, a length extending in an X axis direction perpendicular to the Y axis direction, and a thickness extending in a Z axis direction perpendicular to the X axis direction and the Y axis direction. The chip antennas 100 are arranged in an n×1 array as illustrated in FIG. 1. The chip antennas 100 are arranged in the X axis direction, and side surfaces extending in the Y axis direction of two chip antennas 100 adjacent to each other in the X axis direction among the chip antennas 100 oppose each other in the X-axis direction.

In other examples, the chip antennas 100 are arranged in an n×m array. In these examples, the chip antennas 100 are arranged in both the X axis direction and the Y axis direction, side surfaces extending in the X axis direction of two chip antennas 100 adjacent to each other in the Y axis direction among the chip antennas 100 oppose each other in the Y axis direction, and side surfaces extending in the Y axis direction of two chip antennas 100 adjacent to each other in the X axis direction among the chip antennas 100 oppose each other in the X axis direction.

Centers of ones of the chip antennas 100 that are adjacent to each other in the X axis direction are spaced apart from each other by λ/2 in the X axis direction, and centers of ones of the chip antennas 100 that are adjacent to each other in the Y axis direction are spaced apart from each other by λ/2 in the Y axis direction. "λ" denotes a wavelength of a radio-frequency (RF) signal that the chip antennas 100 are designed to transmit and receive.

When the chip antenna module 1 transmits and receives an RF signal in a band of 20 GHz to 40 GHz having a wavelength λ=14.99 mm to 7.49 mm, the centers of the chip antennas 100 that are adjacent to each other are spaced apart from each other by λ/2=7.5 mm to 3.75 mm. When the chip antenna module 1 transmits and receives an RF signal in a band of 28 GHz having a wavelength λ=10.71 mm, the centers of the chip antennas 100 that are adjacent to each other are spaced apart from each other by λ/2=5.36 mm. A wavelength λ of an RF signal used in a 5G communication system is shorter than a wavelength λ of an RF signal used in a 3G/4G communication system. Accordingly, an energy of the RF signal used in the 5G communication system is higher than an energy of the RF signal used in the 3G/4G communication system. Thus, to reduce interference between RF signals respectively transmitted and received by the chip antennas 100, the chip antennas 100 should be spaced apart from one another by a sufficient spacing distance.

In this example, the interference between the RF signals respectively transmitted and received by the chip antennas 100 is significantly reduced by spacing the centers of the chip antennas 100 apart from each other by λ/2, thereby enabling the chip antenna 100 to be used in a 5G communication system.

In other examples, a spacing distance between the centers of the chip antennas 100 adjacent to each other may be less than λ/2. As will be described later, each of the chip antennas 100 includes ceramic substrates and at least one patch disposed on a portion of at least one of the ceramic substrates. In this case, by spacing the ceramic substrates apart from each other by a certain distance, or disposing a material having a dielectric constant lower than a dielectric constant of the ceramic substrates between the ceramic substrates, an overall dielectric constant of the chip antenna 100 may be decreased. Accordingly, a wavelength of the RF signals respectively transmitted and received by the chip antennas 100 may be increased so that a radiation efficiency and a gain of the chip antenna 100 may be improved. Thus, even when the chip antennas 100 adjacent to each other are disposed so that a spacing distance between the centers of the chip antennas 100 adjacent to each other is less than λ/2 of the RF signals transmitted and received by the chip antennas 100, the interference between the RF signals may be significantly reduced. When the chip antenna module 1 transmits and receives an RF signal in a band of 28 GHz, a spacing distance between the centers of the chip antennas 100 adjacent to each other may be less than 5.36 mm.

Feed pads 16*a* providing feed signals to the chip antennas 100 are disposed on the upper surface of the substrate 10, and the chip antennas 100 are electrically connected to the feed pads 16*a*. A ground layer 16*b* is one of the internal wiring layers of the wiring layers 16 of the substrate 10. In this example, the ground layer 16*b* is the internal wiring layer of the wiring layers 16 that is closest to the upper surface of the substrate 10. The ground layer 16*b* operates as a reflector of the chip antennas 100. Thus, the ground layer 16*b* reflects and focuses the RF signals transmitted by the chip antennas 100 in the Z axis direction, which is a target direction for the transmission of the RF signals.

Upper surface pads 16*c* are disposed on the upper surface of the substrate 10. The upper surfaces pads 16*c* are part of the upper external wiring layer of the wiring layers 16 that is disposed on the upper surface of the substrate 10. The chip antennas 100 are bonded to the upper surface pads 16*c*.

Lower surface pads 16*d* are disposed on the lower surface of the substrate 10. The lower surfaces pads 16*d* are part of the lower external wiring layer of the wiring layers 16 that is disposed on the lower surface of the substrate 10.

An insulating protective layer 19 is disposed on the lower surface of the substrate 10. The insulating protective layer 19 covers a bottom insulating layer among the insulating layers 17 and the lower external wiring layer of the wiring layers 16, and protects the lower external wiring layer of the wiring layers 16. As an example, the insulating protective layer 19 may be made of an insulating resin and an inorganic filler. The insulating protective layer 19 has openings that expose portions of the lower surface pads 16*d*.

The electronic elements 50 are mounted on the lower surface pads 16*d* through the openings in the insulating protective layer 19 using solder balls disposed in the openings.

Figure 2B:
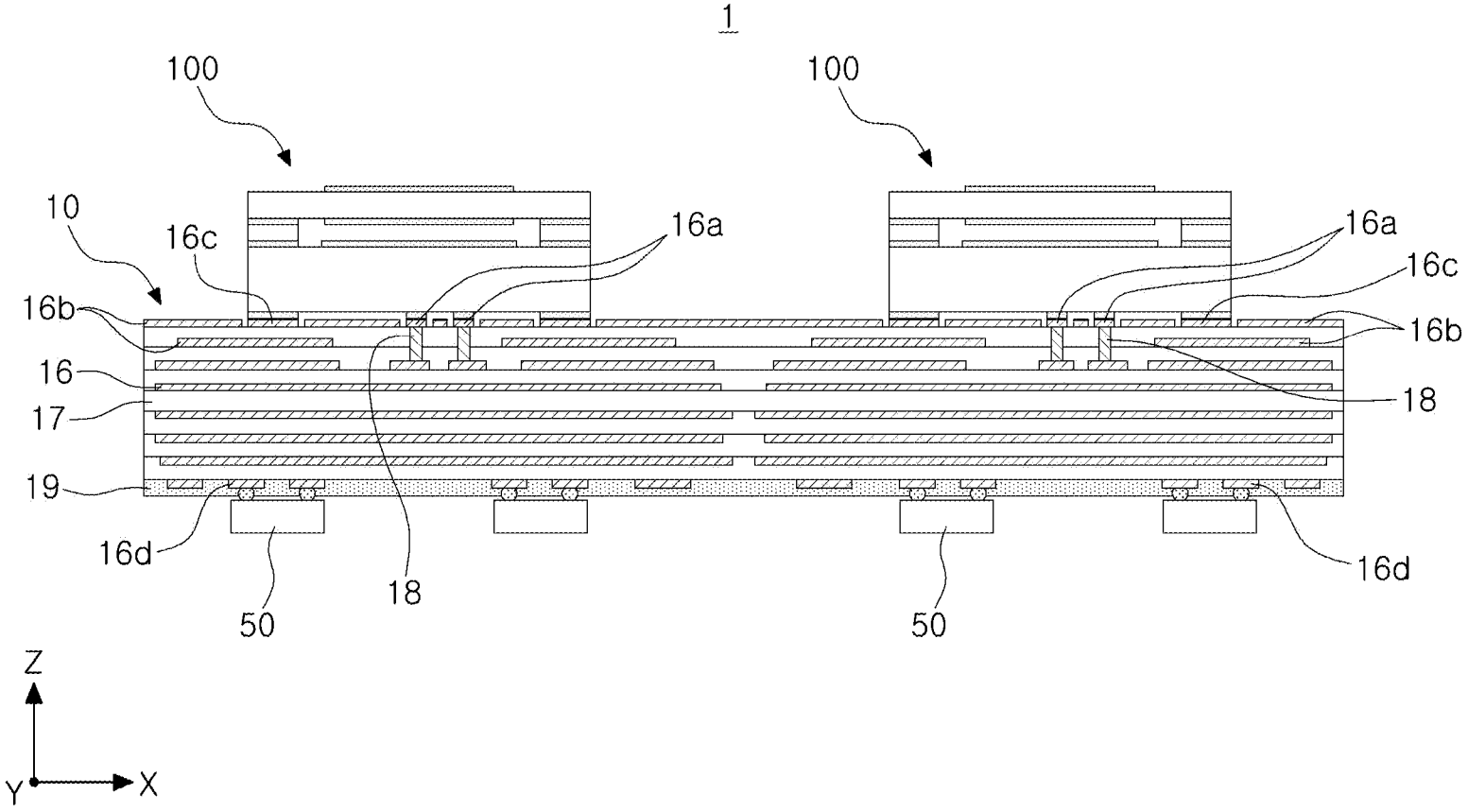
FIGS. 2B, 2C, 2D, 2E, and 2F are diagrams illustrating modified examples of the chip antenna module illustrated in FIG. 2A.
Figure 2C:
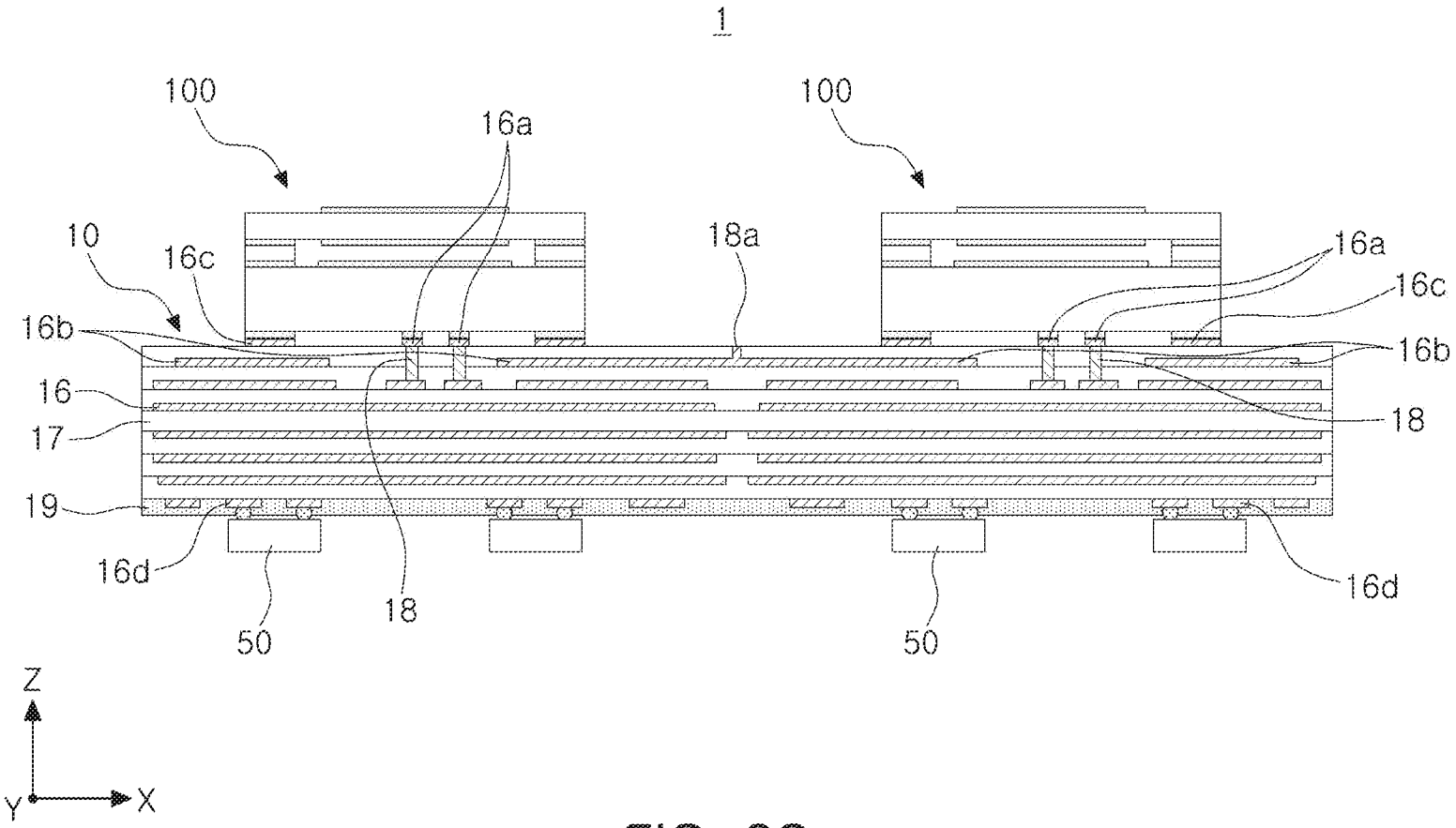
Figure 2D:
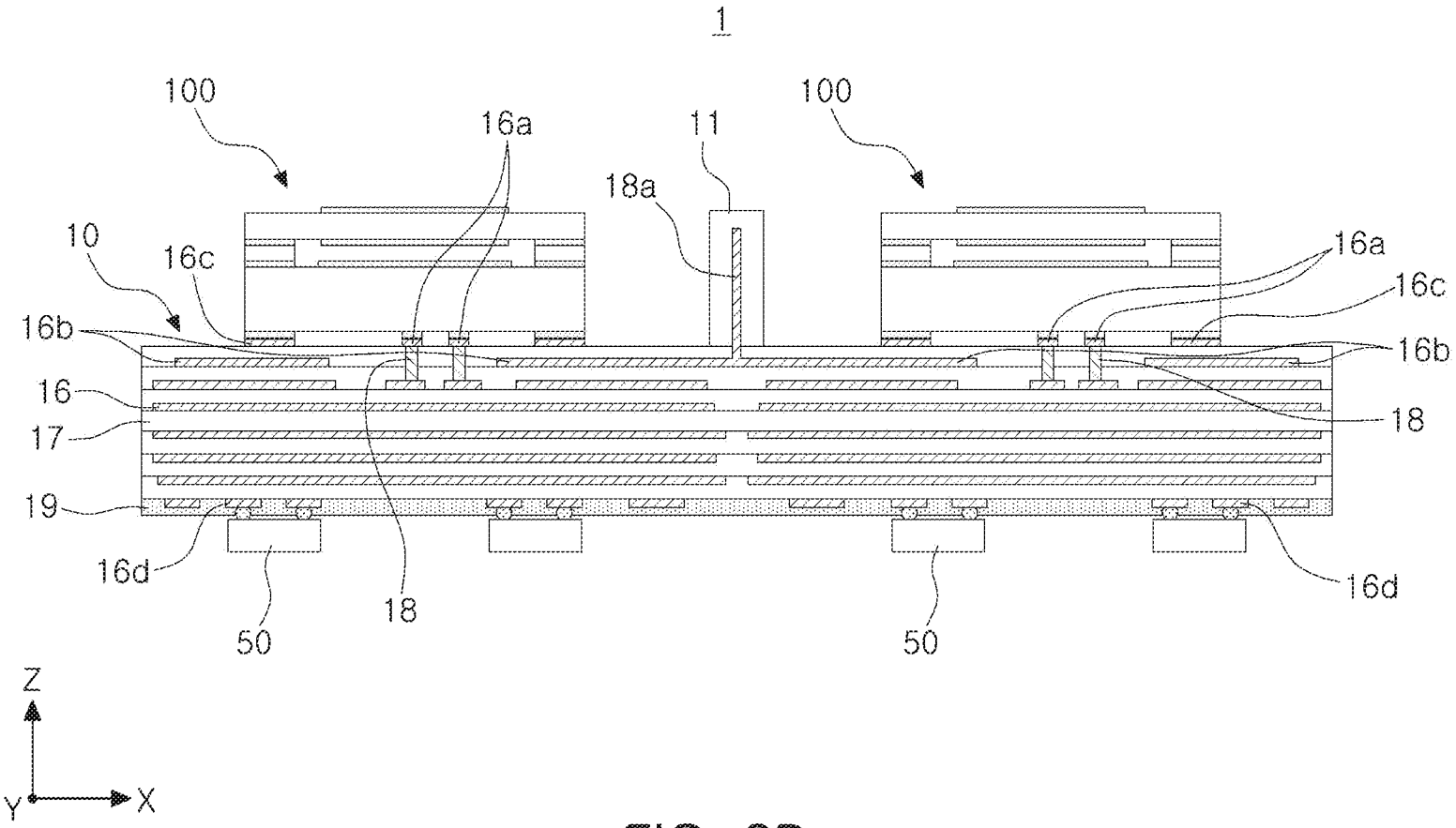

FIGS. 2B, 2C, and 2D are diagrams illustrating modified examples of the chip antenna module illustrated in FIG. 2A.

The chip antenna modules illustrated in FIGS. 2B, 2C, and 2D are similar to the chip antenna module illustrated in FIG. 2A, and thus overlapping descriptions will not be repeated, and only differences will be described.

Referring to FIG. 2B, another ground layer 16*b* is disposed on the upper surface of the substrate 10 in addition to the ground layer 16*b* that is the internal wiring layer of the wiring layers 16 that is closest to the upper surface of the substrate 10. The ground layer 16*b* is part of the upper external layer of the wiring layers 16 that is disposed on the upper surface of the substrate 10, and is disposed in a region of the upper surface of the substrate 10 other than regions of the upper surface of the substrate 10 in which the feed pads 16*a* and the upper surface pads 16*c* are disposed to improve a radiation efficiency of the RF signals transmitted by the chip antennas 100.

Although FIG. 2B shows two ground layers 16*b*, other examples may include only the ground layer 16*b* disposed on the upper surface of the substrate 10.

Referring to FIG. 2C, the substrate further includes a ground via 18*a* connected to the ground layer 16*b* and extending to the upper surface of the substrate 10 from the ground layer 16*b*. The ground via 18*a* is disposed between adjacent chip antennas 100 in the X axis direction.

For example, the ground via 18*a* is disposed equidistant from each of chip antennas 100 in the X axis direction. For example, the ground via 18*a* is spaced apart from the center of each of the adjacent chip antennas 100 by λ/4. As discussed above, "λ" denotes the wavelength of the RF signals that the chip antennas 100 are designed to transmit and receive.

When the chip antenna module 1 transmits and receives an RF signal in a band of 20 GHz to 40 GHz having a wavelength λ=14.99 mm to 7.49 mm, the ground via 18*a* is spaced apart from the center of each of the adjacent chip antennas 100 by λ/4=3.75 mm to 1.875 mm. When the chip antenna module 1 transmits and receives an RF signal in a band of 28 GHz, the ground via 18*a* is spaced apart from the center of each of the adjacent chip antennas 100 by 2.68 mm.

The ground via 18*a* illustrated in FIG. 2C may be one of a plurality of ground vias 18*a* arranged in the Y axis direction between opposing side surfaces of the adjacent chip antennas 100 extending in the Y axis direction. The plurality of ground vias 18*a* may be spaced apart from each other in the Y axis direction over a distance equal to a width of each of the adjacent chip antennas 100 in the Y axis direction. In another example, the ground via 18*a* may be a single metal plate having a width in the Y axis direction equal to the width of each of the adjacent chip antennas 100 in the Y axis direction.

The ground via 18*a* or the plurality of ground vias 18*a* effectively reduce interference between the respective RF signals transmitted and received by the adjacent chip antennas 100.

Referring to FIG. 2D, the substrate 10 further includes a shielding wall 11 protruding from an upper surface of the substrate 100 between the adjacent chip antennas 100. The shielding wall 11 is disposed equidistant from each of the adjacent chip antennas 100. The shielding wall 11 has a width in the Y axis direction equal to the width of the chip antennas 100 in the Y axis direction, and a thickness in the Z direction equal to the thickness of the adjacent chip antennas 100 in the Z axis direction.

The ground via 18*a* connected to the ground layer 16*b* extends into the shielding wall 11. The ground via 18*a* extending into the shielding wall 11 effectively reduces interference between the RF signals respectively transmitted and received by the chip antennas 100.

Figure 2E:
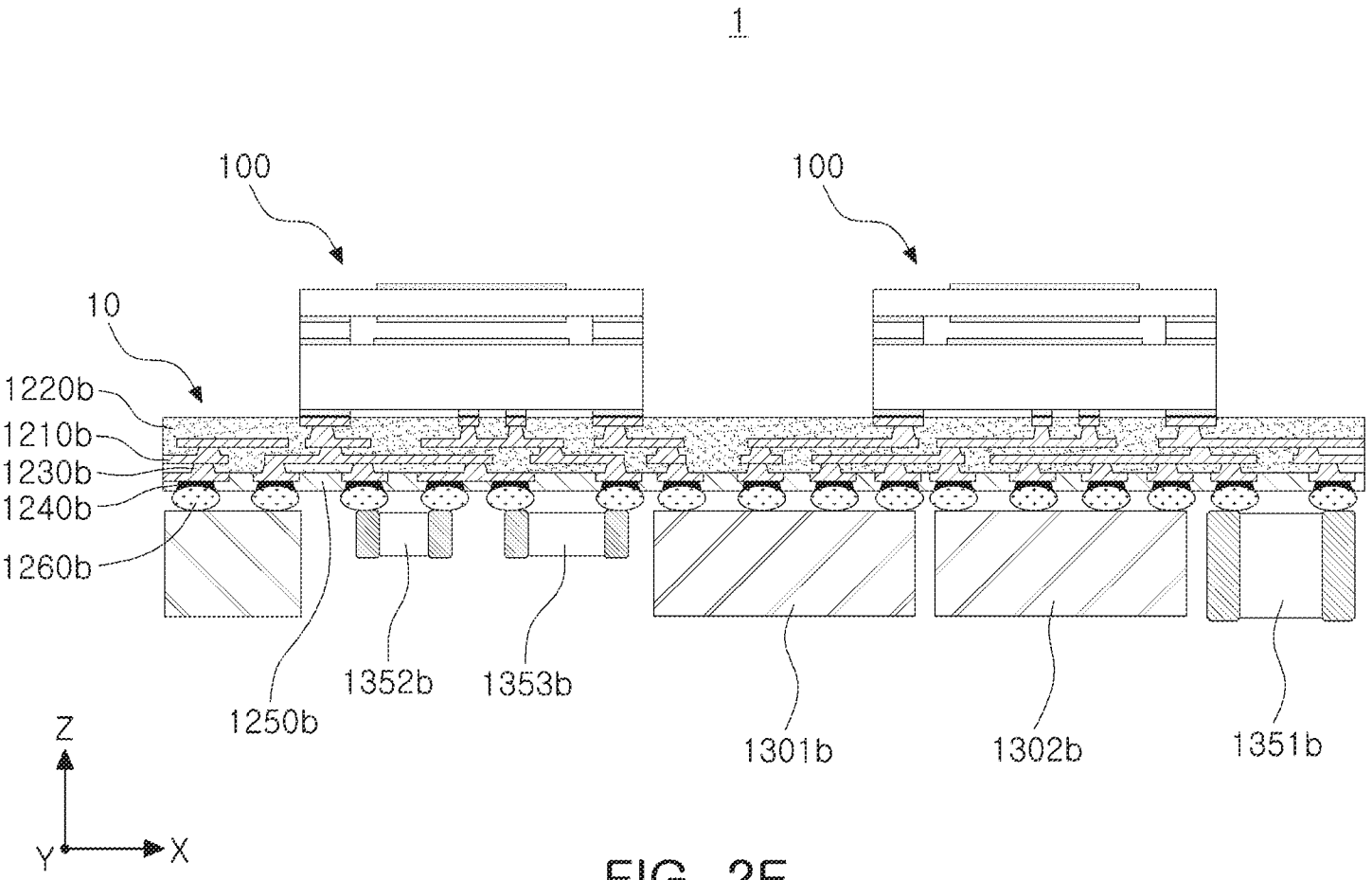
Figure 2F:
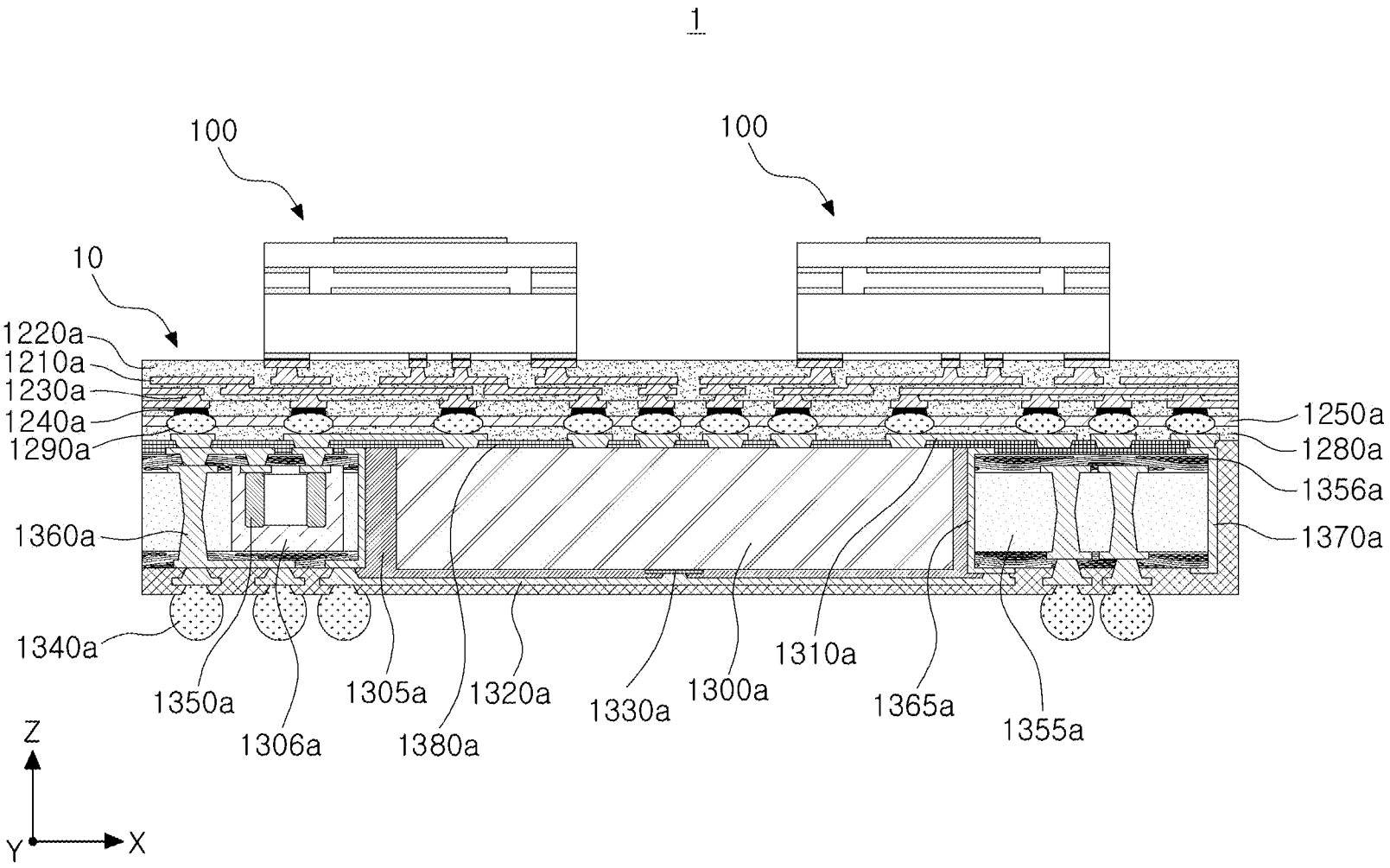

FIGS. 2E and 2F are diagrams illustrating modified examples of the chip antenna module illustrated in FIG. 2A.

The chip antenna modules illustrated in FIGS. 2E and 2F are similar to the chip antenna module illustrated in FIG. 2A, and thus overlapping descriptions will not be repeated, and only differences will be described.

Referring to FIG. 2E, the substrate 10 includes wiring layers 1210*b*, insulating layers 1220*b*, wiring vias 1230*b* connected to the wiring layers 1210*b*, connection pads 1240*b* connected to the wiring vias 1230*b*, and a solder resist layer 1250*b*. The substrate 10 has a structure similar to a structure of a copper redistribution layer (RDL). Chip antennas 100 are disposed on an upper surface of the substrate 10.

An integrated circuit (IC) 1301*b*, a power management integrated circuit (PMIC) 1302*b*, and a plurality of passive components 1351*b*, 1352*b*, and 1353*b* are mounted on a lower surface of the substrate 10 using solder balls 1260*b*. The IC 1301*b* controls a chip antenna module 1. The PMIC 1302*b* generates power, and provides the generated power to the IC 1301*b* through the wiring layers 1210*b*.

The plurality of passive components 1351*b*, 1352*b*, and 1353*b* provide impedances to either one or both of the IC 1301*b* and the PMIC 1302*b*. For example, the plurality of passive components 1351*b*, 1352*b*, and 1353*b* may include any one or any combination of two or more of a capacitor such as a multilayer ceramic capacitor (MLCC), an inductor, and a chip resistor.

Referring to FIG. 2F, a substrate 10 includes wiring layers 1210*a*, insulating layers 1220*a*, wiring vias 1230*a*, connection pads 1240*a*, and a solder resist layer 1250*a*.

An electronic component package is mounted on a lower surface of the substrate 10. The electronic component package includes a support member 1355*a* having an accommodation hole, an IC 1300*a* disposed in the accommodation hole of the support member 1355*a*, an encapsulant 1305*a* encapsulating the IC 1300*a* and filling a gap between the IC 1300*a* and the support member 1355*a*, a wiring layer 1310*a* electrically connected to the IC 1300*a* and the support member 1355*a*, a wiring insulating layer 1380*a* having openings through which portions of the wiring layer 1310*a* protrude, a wiring layer 1320*a*, and a connection member 1280*a* made of an insulating material. Although FIG. 2F appears to show two separate support members 1355*a*, the two support members 1355*a* are actually parts of a single support member 1355*a* that surrounds the IC 1300*a* on all four sides. The two support members 1355*a* only appear to be two support members 1355*a* in FIG. 2F because FIG. 2F is a cross-sectional view of the chip antenna module 1 in FIG. 2F taken along a centerline of the chip antenna module 1 extending in the X axis direction.

RF signals generated by the IC 1300*a* are transmitted to the chip antennas 100 through the wiring layer 1310*a* of the electronic component package and the wiring layers 1210*a* of the substrate 10. Also, RF signals received by the chip antennas 100 are transmitted to the IC 1300*a* through the wiring layers 1210*a* of the substrate 10 and the wiring layer 1310*a* of the electronic component package.

The electronic component package further includes connection pads (not shown in FIG. 2F) disposed on an upper surface of the IC 1300*a*, and a connection pad 1330*a* disposed on a lower surface of the IC 1300*a*. The connection pads disposed on the upper surface of the IC 1300*a* are electrically connected to the portions of the wiring layer 1310*a* that protrude through the openings of the wiring insulating layer 1380*a*, and the connection pad 1330*a* disposed on the lower surface of the IC 1300*a* is electrically connected to the wiring layer 1320*a*.

The support member 1355*a* includes a core dielectric layer 1356*a* and a plurality of core vias 1360*a* penetrating the core dielectric layer 1356*a* and electrically connected to the wiring layer 1320*a*. The core vias 1360*a* are electrically connected to an electrical interconnect structure 1340*a* such as solder balls, pins, or lands. A base band signal and power applied to the electrical interconnect structure 1340 are transmitted to the IC 1300*a* through the wiring layer 1320*a*, the core vias 1360*a*, and the wiring layer 1310*a*.

The IC 1300*a* generates an RF signal in an mmWave band using the base band signal and the power. For example, the IC 1300*a* receives a base band signal having a low frequency and performs frequency conversion, amplification, filtering, phase control, and power generation on the base band signal to generate an RF signal. The IC 1300*a* may be fabricated from a compound semiconductor (e.g., GaAs) or a silicon semiconductor so that the IC 1300*a* has good RF properties. The electronic component package further includes a passive component 1350*a* electrically connected to the wiring layer 1310*a*. The passive component 1350*a* is disposed in an accommodation space 1306*a* in one of the support members 1355*a*. The passive component 1350*a* may include any one or any combination or any two or more of a capacitor such as a multilayer ceramic capacitor, an inductor, and a chip resistor.

The electronic component package further includes an inside core plating member 1365*a* covering an inside surface of the support member 1355*a*, and an outside core plating member 1370*a* covering an outside surface of the support member 1355*a*. The inside core plating member 1365*a* is electrically connected to the wiring layer 1320*a*, provides a ground voltage to the IC 1300*a*, and the outside core plating member 1370*a* provides a ground to the substrate 10. The inside core plating member 1365*a* also prevents electronic noise from entering the IC 1300*a*, and the outside core plating member 1370*a* also externally dissipates heat generated by the IC 1300*a*.

The elements of the electronic component package excluding the connection member 1280*a* may be manufactured separately from the connection member 1280*a* and then combined with the connection member 1280*a*, but in other examples, the elements of the electronic component package and the connection member may be manufactured together. In FIG. 2F, the electronic component package is combined with the substrate 10 through a electrical interconnect structure 1290*a* and the solder resist layer 1250*a*, but in other examples, the electrical interconnect structure 1290*a* and the solder resist layer 1250*a* may be omitted.

Referring back to FIG. 3A, each of the end-fire antennas 200 includes an end-fire antenna pattern 210, a director pattern 215, and an end-fire feed line 220.

The end-fire antenna pattern 210 transmits and receives an RF signal in the Y direction, i.e., in a direction away from a side surface of the substrate 10. The end-fire antenna pattern 210 is disposed on the side surface of the substrate 10, and may have a dipole form or a folded dipole form. The director pattern 215 is electromagnetically coupled to the end-fire antenna pattern 210 to improve either one or both of a gain and a bandwidth of the end-fire antenna pattern 210. The end-fire feed line 220 supplies an RF signal received by the end-fire antenna pattern 210 to an electronic component or an IC, and supplies an RF signal received from the electronic component or the IC to the end-fire antenna pattern 210.

The end-fire antennas 200 formed by wiring patterns as illustrated in FIG. 3A may be implemented instead as chip-type end-fire antennas 200 mounted on a bottom surface of the substrate 10 as illustrated in FIG. 3B.

Referring to FIG. 3B, each of the end-fire antennas 200 includes a body portion 230, a radiation portion 240, and a ground portion 250.

The body portion 230 has a hexahedral shape, and is made of a dielectric material. For example, the body portion 230 may be made of a polymer or a ceramic sintering material having a certain dielectric constant.

The radiation portion 240 is bonded to a first surface of the body portion 230, and the ground portion 250 is bonded to a second surface of the body portion 230 opposing the first surface. The radiation portion 240 and the ground portion 250 are made of the same conductive material. The radiation portion 240 and the ground portion 250 are made of any one of Ag, Au, Cu, Al, Pt, Ti, Mo, Ni, and W, or an alloy of any two or more of Ag, Au, Cu, Al, Pt, Ti, Mo, Ni, and W. The radiation portion 240 and the ground portion 250 have the same shape and the same structure. When the radiation portion 240 and the ground portion 250 are mounted on the bottom surface of the substrate 10, the radiation portion 240 and the ground portion 250 are distinguished from each other by a type of pad disposed on the bottom surface of the substrate 10 to which they are bonded. For example, a portion bonded to a feed pad disposed on the bottom surface of the substrate 10 (not shown in FIG. 3B) operates as the radiation portion 240, and a portion bonded to a ground pad disposed on the bottom surface of the substrate 10 (not shown in FIG. 3B) operates as the ground portion 250.

The chip-type end-fire antennas 200 may have a capacitance because the body portion 230 disposed between the radiation portion 240 and the ground portion 250 is made of a dielectric material. Accordingly, a coupling antenna may be designed or a resonance frequency may be tuned using the capacitance.

In general, to obtain sufficiently good antenna properties of a pattern-type patch antenna implemented by patterns in a multilayer substrate, a plurality of layers need to be included in the substrate, which may excessively increase a volume of the patch antenna. The increase in volume may be lessened by making the insulating layers of the multilayer substrate of an insulating material having a relatively high dielectric constant, thereby making it possible to reduce a thickness of the insulating layers, and reduce a size and a thickness of pattern-type patch antenna.

However, when a dielectric constant of the insulating layers is increased, a wavelength of an RF signal is shortened so that the RF signal may be absorbed in the insulating layers having a high dielectric constant, which may significantly decrease a radiation efficiency and a gain of the RF signal.

In the examples illustrated in FIGS. 1 to 3B, a pattern-type patch antenna implemented by patterns in a multilayer substrate is replaced by the chip-type patch antennas 100, thereby significantly reducing the number of layers of the substrate. Accordingly, manufacturing costs and a volume of the chip antenna module 1 are reduced.

Also, by making the dielectric constant of the ceramic substrates of the chip antennas 100 to be higher than a dielectric constant of the insulating layers included in the substrate 10, a size of the chip antennas 100 may be reduced.

Also, by spacing the ceramic substrates of the chip antenna 100 apart from each other by a certain distance or by disposing a material having a dielectric constant lower than a dielectric constant of the ceramic substrates between the ceramic substrates, an overall dielectric constant of the chip antennas 100 may be reduced. Accordingly, a size of the chip antenna module 1 may be decreased, and a wavelength of the RF signal may be increased, thereby improving the radiation efficiency and the gain of the RF signal. An overall dielectric constant of the chip antennas 100 may be an overall dielectric constant of the ceramic substrates of the chip antennas 100 and a gap between the ceramic substrates, or an overall dielectric constant of the ceramic substrates of the chip antennas 100 and a material disposed between the ceramic substrates. Thus, when the ceramic substrates of the chip antennas 100 are spaced apart from each other by a certain distance, or a material having a dielectric constant lower than a dielectric constant of the ceramic substrates is disposed between the ceramic substrates, an overall dielectric constant of the chip antenna 100 may be lower than a dielectric constant of the ceramic substrates.

Figure 4A:
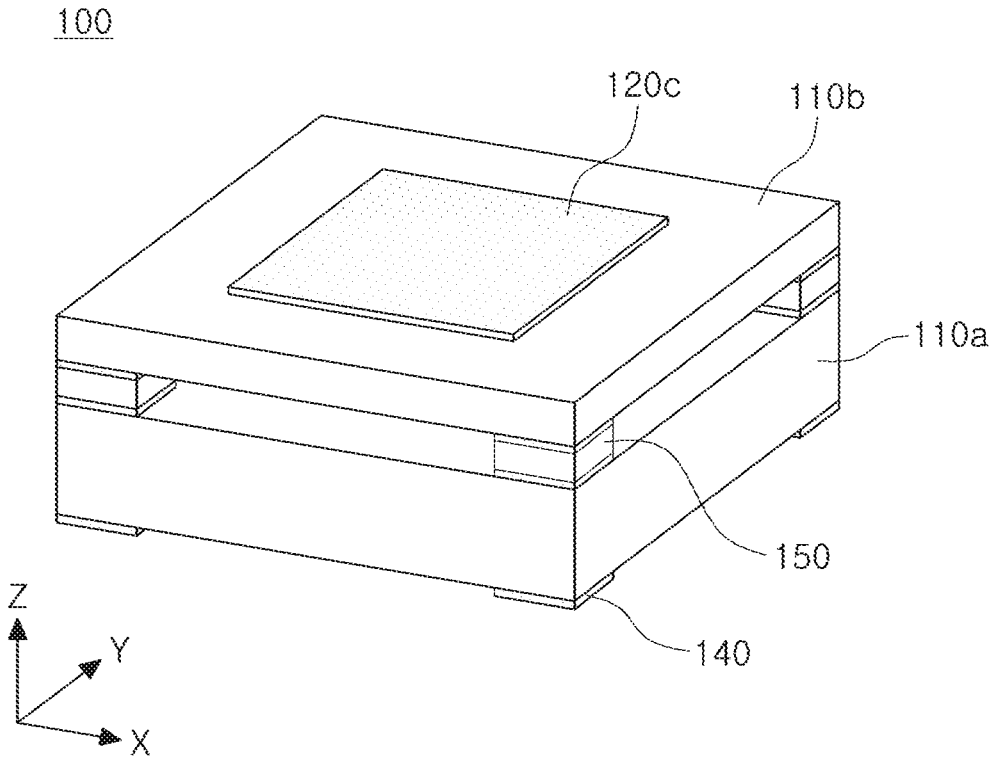
FIG. 4A is a perspective diagram illustrating an example of a chip antenna.
Figure 4B:
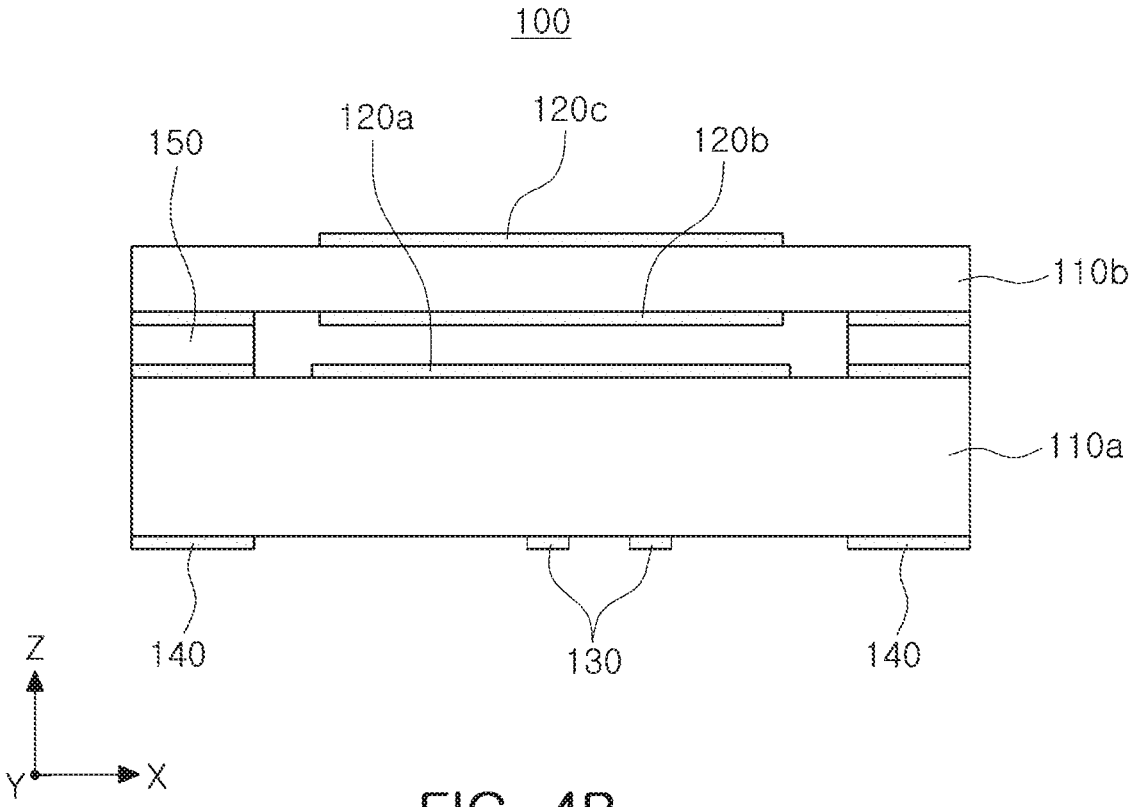
FIG. 4B is a side elevation diagram illustrating the chip antenna illustrated in FIG. 4A.
Figure 4C:
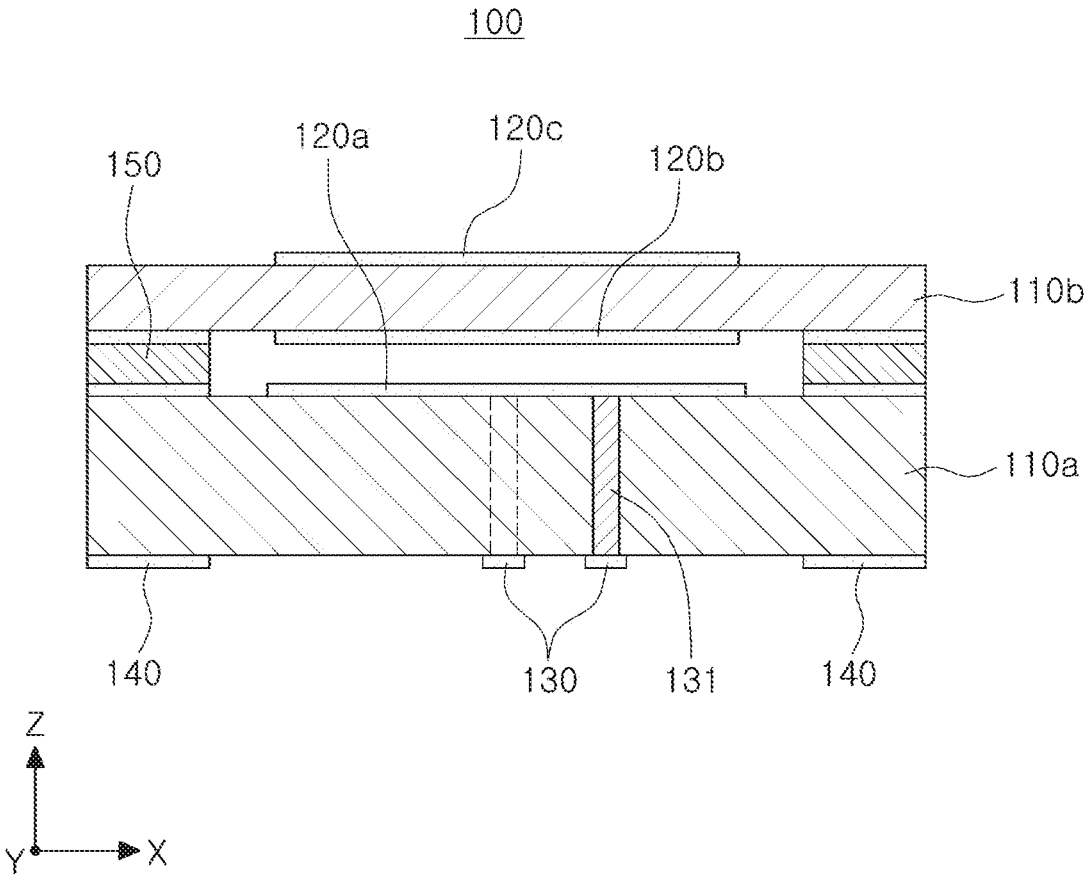
FIG. 4C is a cross-sectional diagram illustrating the chip antenna illustrated in FIG. 4A.
Figure 4D:
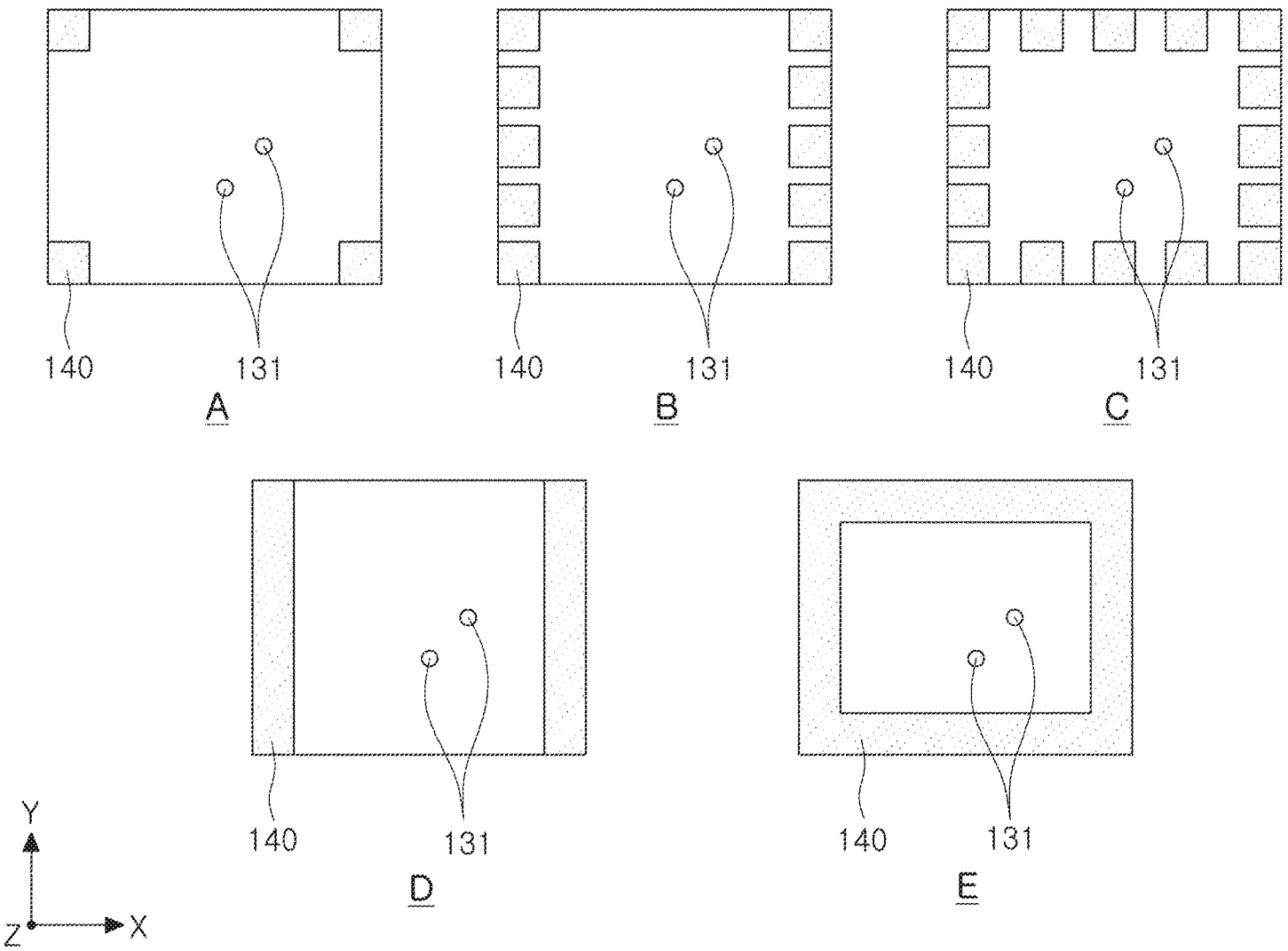
FIG. 4D is a bottom elevation diagram illustrating different examples of the chip antenna illustrated in FIG. 4A.
Figure 4E:
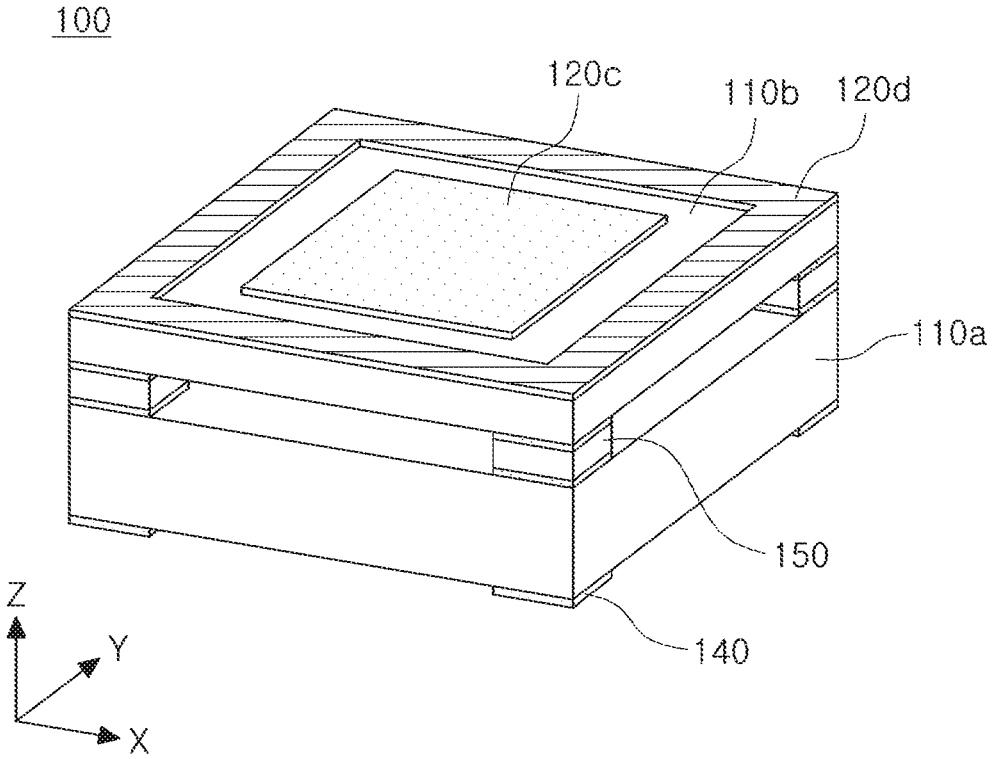
FIG. 4E is a perspective diagram illustrating a modified example of the chip antenna illustrated in FIG. 4A.

FIG. 4A is a perspective diagram illustrating an example of a chip antenna. FIG. 4B is a side elevation diagram illustrating the chip antenna illustrated in FIG. 4A. FIG. 4C is a cross-sectional diagram illustrating the chip antenna illustrated in FIG. 4A. FIG. 4D is a bottom elevation diagram illustrating different examples of the chip antenna illustrated in FIG. 4A. FIG. 4E is a perspective diagram illustrating a modified example of the chip antenna illustrated in FIG. 4A.

Referring to FIGS. 4A, 4B, 4C, and 4D, a chip antenna 100 includes a first ceramic substrate 110*a*, a second ceramic substrate 110*b*, and a first patch 120*a*, a second patch 120*b*, and a third patch 120*c*.

The first patch 120*a* is a metal plate having a certain area. The first patch 120*a* is illustrated as having a rectangular shape, but the shape of the first patch 120*a* is not limited thereto. In other examples, the first patch 120*a* may have other various shapes such as a polygonal shape, a circular shape, or any other shape. The first patch 120*a* is connected to feed vias 131 and operates as a feed patch.

The second patch 120*b* and the third patch 120*c* are spaced apart from the first patch 120*a*, and are metal plates having certain areas. An area of each of the second patch 120*b* and the third patch 120*c* may be the same as or different from an area of the first patch 120*a*. As an example, each of the second patch 120*b* and the third patch 120*c* may have an area smaller than an area of the first patch 120*a*, and may be disposed above the first patch 120*a*. For example, each of the second patch 120*b* and the third patch 120*c* may have an area smaller than an area of the first patch 120*a* by 5% to 8%. As an example, a thickness of each of the first patch 120*a*, the second patch 120*b*, and the third patch 120*c* may be 20 μm.

The second patch 120*b* and the third patch 120*c* are electromagnetically coupled to the first patch 120*a*, and operate as radiation patches. The second patch 120*b* and the third patch 120*c* focus an RF signal in the Z axis direction, which is a mounting direction of the chip antenna 100, and improve either one or both of a gain and a bandwidth of the first patch 120*a*.

The first patch 120*a*, the second patch 120*b*, and the third patch 120*c* are made of any one of Ag, Au, Cu, Al, Pt, Ti, Mo, Ni, W, or an alloy including any two or more of Ag, Au, Cu, Al, Pt, Ti, Mo, Ni, W. Alternatively, the first patch 120*a*, the second patch 120*b*, and the third patch 120*c* are made of a conductive paste or a conductive epoxy.

The first patch 120*a*, the second patch 120*b*, and the third patch 120*c* are formed by layering a copper foil on a front surface of a ceramic substrate, and patterning the copper foil in accordance with a designed shape. To pattern the copper foil, an etching process such as a lithography process may be used. Alternatively, the first patch 120*a*, the second patch 120*b*, and the third patch 120*c* may be formed by forming a seed layer by an electroless plating process, and forming the first patch 120*a*, the second patch 120*b*, and the third patch 120*c* on the seed layer by a subsequent electroplating process, or may be formed by forming a seed layer by a sputtering process, and forming the first patch 120*a*, the second patch 120*b*, and the third patch 120*c* on the seed layer by a subsequent electroplating process.

Alternatively, the first patch 120*a*, the second patch 120*b*, and the third patch 120*c* may be made by printing and curing a conductive paste or a conductive epoxy on a ceramic substrate in the shapes of the first patch 120*a*, the second patch 120*b*, and the third patch 120*c*. By using the printing process, the first patch 120*a*, the second patch 120*b*, and the third patch 120*c* may be directly formed in accordance with a designed shape without a needing separate etching process.

In some examples, a protective layer in the form of a film may be formed on a surface of each of the first patch 120*a*, the second patch 120*b*, and the third patch 120*c* by a plating process. The protective layer may be formed by layering a nickel (Ni) layer and a tin (Sn) layer in order, or by layering a zinc (Zn) layer and a tin (Sn) layer in order. The protective layer formed on the surface of each of the first patch 120*a*, the second patch 120*b*, and the third patch 120*c* prevents oxidation of the first patch 120*a*, the second patch 120*b*, and the third patch 120*c*. The protective layer may also be formed on surfaces of the feed pads 130, the feed vias 131, the bonding pads 140, and the spacer 150.

The first ceramic substrate 110*a* may be made of a dielectric material having a certain dielectric constant. For example, the first ceramic substrate 110*a* may be made of a ceramic sintering material in a hexahedral shape. The first ceramic substrate 110*a* may include magnesium (Mg), silicon (Si), aluminum (Al), calcium (Ca), and titanium (Ti). For example, the first ceramic substrate 110*a* may include $Mg_2SiO_4$, $MgAl_2O_4$, and $CaTiO_3$. As another example, the first ceramic substrate 110*a* may further include $MgTiO_3$ in addition to $Mg_2SiO_4$, $MgAl_2O_4$, and $CaTiO_3$, and in other examples, $CaTiO_3$ may be replaced with $MgTiO_3$, and the first ceramic substrate 110*a* may include $Mg_2SiO_4$, $MgAl_2O_4$, and $MgTiO_3$.

When a distance between the ground layer 16*b* of the chip antenna module 1 and the first patch 120*a* of the chip antenna 100 is λ/10 to λ/20, the ground layer 16*b* will reflect an RF signal output from the chip antenna 100 in a target direction effectively.

When the ground layer 16*b* is disposed on the upper surface of the substrate 10, a distance between the ground layer 16*b* of the chip antenna module 1 and the first patch 120*a* of the chip antenna 100 is almost the same as a sum of a thickness of the first ceramic substrate 110*a* and a thickness of the bonding pad 140.

Thus, a thickness of the first ceramic substrate 110*a* may be determined in accordance with a designed distance (λ/10 to λ/20) between the ground layer 16*b* and the first patch 120*a*. As an example, a thickness of the first ceramic substrate 110*a* may be 90 to 95% of λ/10 to λ/20. Also, as an example, when a dielectric constant of the first ceramic substrate 110*a* is 5 to 12 at 28 GHz, a thickness of the first ceramic substrate 110*a* may be 150 to 500 μm.

The first patch 120*a* is disposed on an upper surface of the first ceramic substrate 110*a*, and the feed pads 130 are disposed on a lower surface of the first ceramic substrate 110*a*. A thickness of the feed pads 130 may be 20 μm.

The feed pads 130 disposed on the lower surface of the first ceramic substrate 110*a* are electrically connected to the feed pads 16*a* disposed on the upper surface of the substrate 10. The feed pads 130 are electrically connected to the feed vias 131 penetrating the first ceramic substrate 110*a* in a thickness direction (the Z axis direction) of the first ceramic substrate 110*a*, and the feed vias 131 may provide feed signals to the a first patch 120*a* disposed on the upper surface of the first ceramic substrate 110*a*. One of the feed vias 131 may be configured as a feed line for generating an RF signal have a first polarization, and the other one of the feed vias 131 may be configured as a feed line for generating an RF signal having a second polarization orthogonal to the first polarization. A diameter of the feed vias 131 may be 150

μm. The bonding pads 140 are disposed on the lower surface of the first ceramic substrate 110*a*. The bonding pads 140 disposed on the lower surface of the first ceramic substrate 110*a* may be mutually bonded with respective ones of upper surface pads 16*c* disposed on the upper surface of the substrate 10. As an example, the bonding pads 140 of the chip antenna 100 may be bonded to the respective upper surface pads 16*c* of the substrate 10 using a solder paste. A thickness of the bonding pads 140 may be 20 μm.

Referring to diagram A in FIG. 4D, a plurality of bonding pads 140 are respectively disposed on corners of the lower surface of the first ceramic substrate 11*a*.

Referring to diagram B in FIG. 4D, a plurality of bonding pads 140 are disposed along opposite sides of the lower surface of the first ceramic substrate 110*a*, and are spaced apart from each other by a certain distance.

Referring to diagram C in FIG. 4D, a plurality of bonding pads 140 along all four sides of the lower surface of the first ceramic substrate 110*a*, and are spaced apart from each other by a certain distance.

Referring to diagram D in FIG. 4D, a plurality of bonding pads 140 are disposed along opposite sides of the lower surface of the first ceramic substrate 110*a*, and each have a length equal to a length of each of the opposite sides.

Referring to diagram E in FIG. 4D, a single bonding pad 140 is disposed along all four sides of the lower surface of the first ceramic substrate 110*a*, and has a length equal to a total length of the four sides.

In the diagrams A, B, and C in FIG. 4D, the bonding pads 140 have a rectangular shape, but the shape of the bonding pads 140 is not limited thereto. In other examples, the bonding pads 140 may have other shapes such as a circular shape or any other shape. Also, in the diagrams A, B, C, D, and E in FIG. 4D, the bonding are 140 are disposed adjacent to the sides of the lower surface of the first ceramic substrate 110*a*, but the positions of the bonding pads 140 are not limited thereto. In other examples, the bonding pads 140 may be spaced apart from the sides of the lower surface of the first ceramic substrate 110*a* by a certain distance.

The second ceramic substrate 110*b* may be made of a dielectric material having a certain dielectric constant. For example, the second ceramic substrate 110*b* may be made of a ceramic sintering material having a hexahedral shape similar to the shape of the first ceramic substrate 110*a*. The second ceramic substrate 110*b* may have the same dielectric constant as the first ceramic substrate 110*a*. In other examples, the second ceramic substrate 110*b* may have a dielectric constant that is different from the dielectric constant of the first ceramic substrate 110*a*. As an example, the dielectric constant of the second ceramic substrate 110*b* may be higher than the dielectric constant of the first ceramic substrate 110*a*. When the dielectric constant of the second ceramic substrate 110*b* is higher than the dielectric constant of the first ceramic substrate 110*a*, an RF signal may be radiated to a side of the second ceramic substrate 110*b*, thereby improving a gain of the RF signal.

The second ceramic substrate 110*b* may have a thickness less than a thickness of the first ceramic substrate 110*a*. A thickness of the first ceramic substrate 110*a* may be 1 to 5 times greater than a thickness of the second ceramic substrate 110*b*, for example, 2 to 3 times greater than a thickness of the second ceramic substrate 110*b*. As an example, a thickness of the first ceramic substrate 110*a* may be 150 to 500 μm, and a thickness of the second ceramic substrate 110*b* may be 100 to 200 μm, for example, 50 to 200 μm. Alternatively, the second ceramic substrate 110*b* may have a thickness equal to a thickness of the first ceramic substrate 110*a*.

An appropriate distance is maintained between the first patch 120*a* and the second patch 120*b* in accordance with a thickness of the spacers 150, and an appropriate distance is maintained between the second patch 120*b* and the third patch 120*c* in accordance with a thickness of the second ceramic substrate 110*b*, thereby improving a radiation efficiency of the RF signal.

Dielectric constants of the first ceramic substrate 110*a* and the second ceramic substrate 110*b* may be higher than a dielectric constant of the substrate 10, for example, a dielectric constant of the insulating layers 17 of the substrate 10. As an example, dielectric constants of the first ceramic substrate 110*a* and the second ceramic substrate 110*b* may be 5 to 12 at 28 GHz, and a dielectric constant of the substrate 10 may be 3 to 4 at 28 GHz. Accordingly, a volume of the chip antenna 100 may be reduced, and an overall size of the chip antenna module 1 may be reduced. As an example, the chip antenna 100 may have a small size having a length of 3.4 mm, a width of 3.4 mm, and a thickness of 0.64 mm, for example. The second patch 120*b* is disposed on the lower surface of the second ceramic substrate 110*b*, and the third patch 120*c* is disposed on the upper surface of the second ceramic substrate 110*b*.

Referring to FIG. 4E, a shielding electrode 120*d* insulated from the third patch 120*c* and disposed along the edges of the second ceramic substrate 110*b* is disposed on the upper surface of the second ceramic substrate 110*b*. When the chip antennas 100 are arranged in an array such as an n×1 array, the shielding electrode 120*d* reduces interference between the chip antennas 100. Accordingly, when the chip antennas 100 are arranged in a 4×1 array as illustrated in FIG. 1, the chip antenna module 1 illustrated in FIG. 1 may be manufactured as a small-size chip antenna module 1 having a length of 19 mm, a width of 4.0 mm, and a thickness of 1.04 mm.

The first ceramic substrate 110*a* and the second ceramic substrate 110*b* are spaced apart from each other by the spacers 150. The spacers 150 are disposed on the corners of the upper surface of the first ceramic substrate 110*a* and the lower surface of the second ceramic substrate 110*b* between the first ceramic substrate 110*a* and the second ceramic substrate 110*b*. Alternatively, in other examples, the spacers 150 along opposite sides of the upper surface of the first ceramic substrate 110*a* and the lower surface of the second ceramic substrate 110*b*, or may be disposed along all four sides of the upper surface of the first ceramic substrate 110*a* and the lower surface of the second ceramic substrate 110*b* to stably support the second ceramic substrate 110*b* above the first ceramic substrate 110*a*. Accordingly, by including the spacers 150, a gap is formed between the first patch 120*a* disposed on the upper surface of the first ceramic substrate 110*a* and the second patch 120*b* disposed on the lower surface of the second ceramic substrate 110*b*. A space formed by the gap is filled with air, which has a dielectric constant of 1, so an overall dielectric constant of the chip antenna 100 is decreased.

By making the first ceramic substrate 110*a* and the second ceramic substrate 110*b* from a material having a dielectric constant higher than a dielectric constant of the substrate 10, a size of the chip antenna module 1 may be reduced. Also, by providing a gap between the first ceramic substrate 110*a* and the second ceramic substrate 110*b*, an overall dielectric constant of the chip antenna 100 decreases, thereby improving a radiation efficiency and a gain of the chip antenna 100.

FIGS. 5A to 5F are diagrams illustrating processes of an example of a method of manufacturing the chip antenna illustrated in FIGS. 4A to 4C and diagram A of FIG. 4D. FIGS. 5A to 5F illustrate an example in which a single chip antenna is separately manufactured, but in other examples, a plurality of chip antennas may be manufactured in an integrated form through the manufacturing method illustrated in FIGS. 5A to 5F, and the plurality of chip antennas integrated with one another may be divided into individual chip antennas through a dicing process.

Figure 5A:
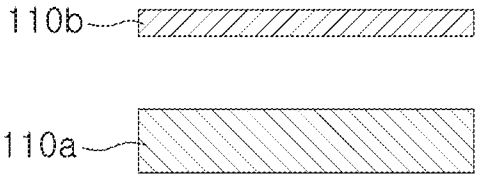
FIGS. 5A to 5F are diagrams illustrating processes of an example of a method of manufacturing the chip antenna illustrated in FIGS. 4A to 4C and diagram A of FIG. 4D.
Figure 5B:
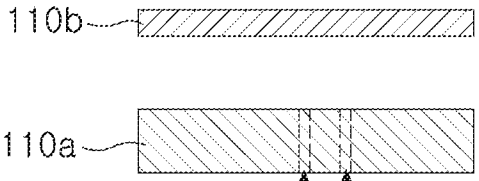
Figure 5C:
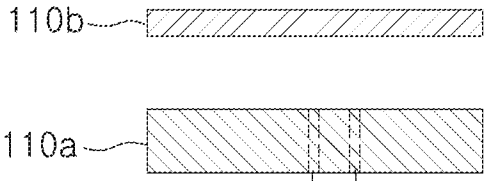
Figure 5D:
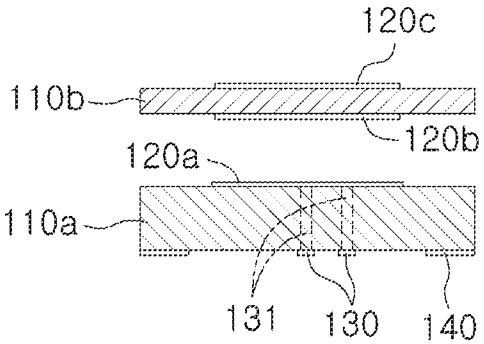

Referring to FIGS. 5A to 5F, a method of manufacturing the chip antenna illustrated in FIGS. 4A to 4C and diagram D of FIG. 4D starts with preparing a first ceramic substrate 110*a* and a second ceramic substrate 110*b* (FIG. 5A). Via holes VH penetrating the first ceramic substrate 110*a* in a thickness direction are formed (FIG. 5B), and an internal space of the via holes VH is coated with or filled with a conductive paste to form feed vias 131 (FIG. 5C). The internal space of the via holes VH may be completely filled with the conductive paste, or an internal surface of the via holes VH may be coated with a uniform thickness of the conductive paste.

After forming the feed vias 131, by printing and curing a conductive paste or a conductive epoxy on the first ceramic substrate 110*a* and the second ceramic substrate 110*b*, a first patch 120*a* is formed on an upper surface of the first ceramic substrate 110*a*, feed pads 130 and bonding pads 140 are formed on a lower surface of the first ceramic substrate 110*a*, a second patch 120*b* is formed on a lower surface of the second ceramic substrate 110*b*, and a third patch 120*c* is formed on an upper surface of the second ceramic substrate 110*b*.

Figure 5E:
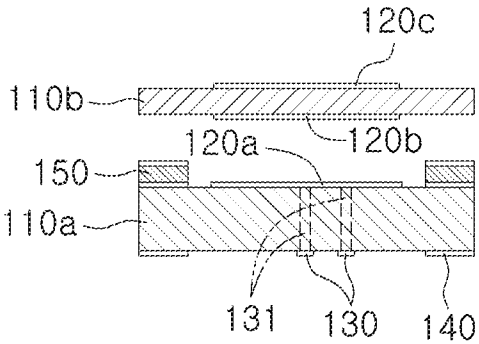
Figure 5F:
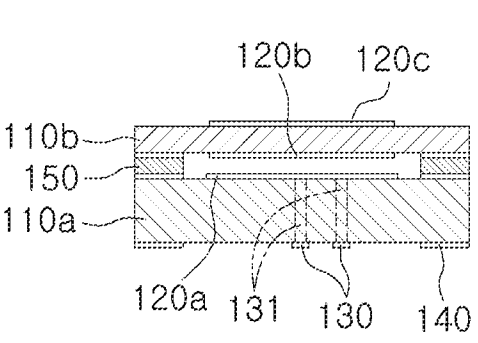

Spacers 150 are formed by thick-film printing and curing a conductive paste or a conductive epoxy on the corners of the upper surface of the first ceramic substrate 110*a* (FIG. 5E). After forming the spacers 150, a conductive paste or a conductive epoxy (not shown) is printed on upper surfaces of the spacers 150 one or more times, and the second ceramic substrate 110*b* is pressed onto the conductive paste or the conductive epoxy printed on the upper surfaces of the spacers 150 before the conductive paste or the conductive epoxy printed on the upper surfaces of the spacers 150 has cured (FIG. 5F). After the conductive paste or the conductive epoxy printed on the upper surfaces of the spacers 150 has cured, a protective layer (not illustrated) is formed on each of the first patch 120*a*, the second patch 120*b*, the third patch 120*c*, the feed pads 130, the feed vias 131, the bonding pads 140, and the spacers 150 through a plating process. The protective layer prevents oxidation of the first patch 120*a*, the second patch 120*b*, the third patch 120*c*, the feed pads 130, the feed vias 131, the bonding pads 140, and the spacers 150. After the protective layer has been formed, if a plurality of chip antennas integrated with one another have been formed, the plurality of chip antennas integrated with one another are divided through a dicing process, thereby obtaining individual chip antennas.

Figure 6A:
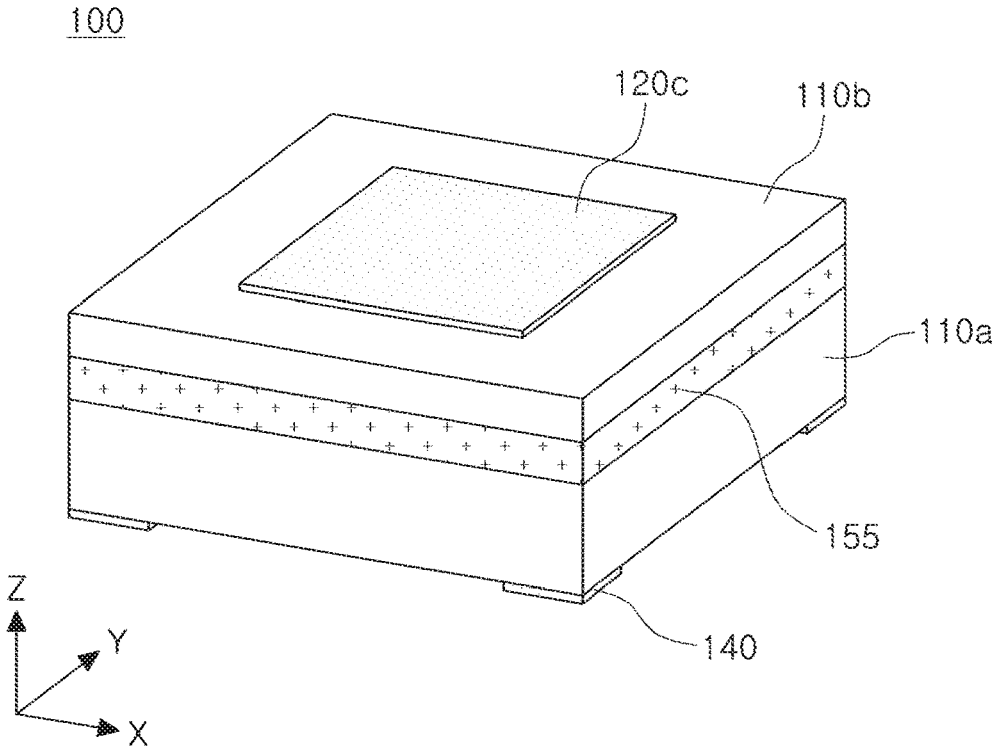
FIG. 6A is a perspective diagram illustrating another example of a chip antenna.
Figure 6B:
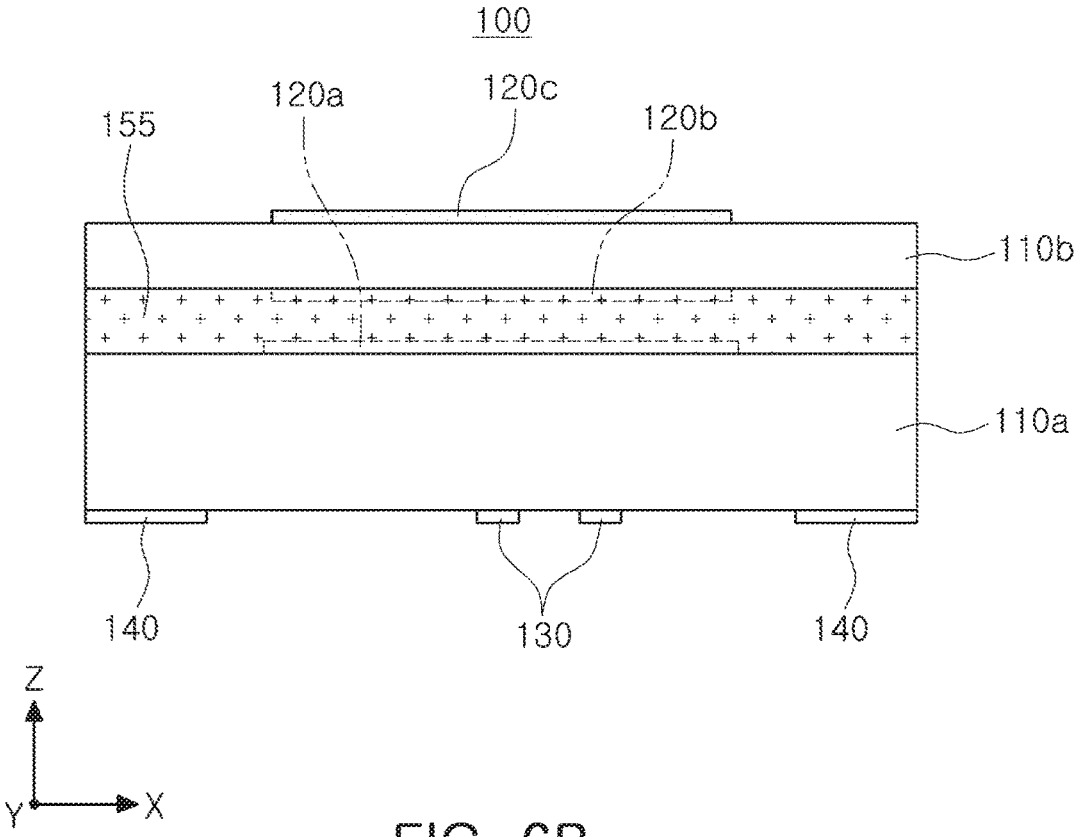
FIG. 6B is a side elevation diagram illustrating the chip antenna illustrated in FIG. 6A.
Figure 6C:
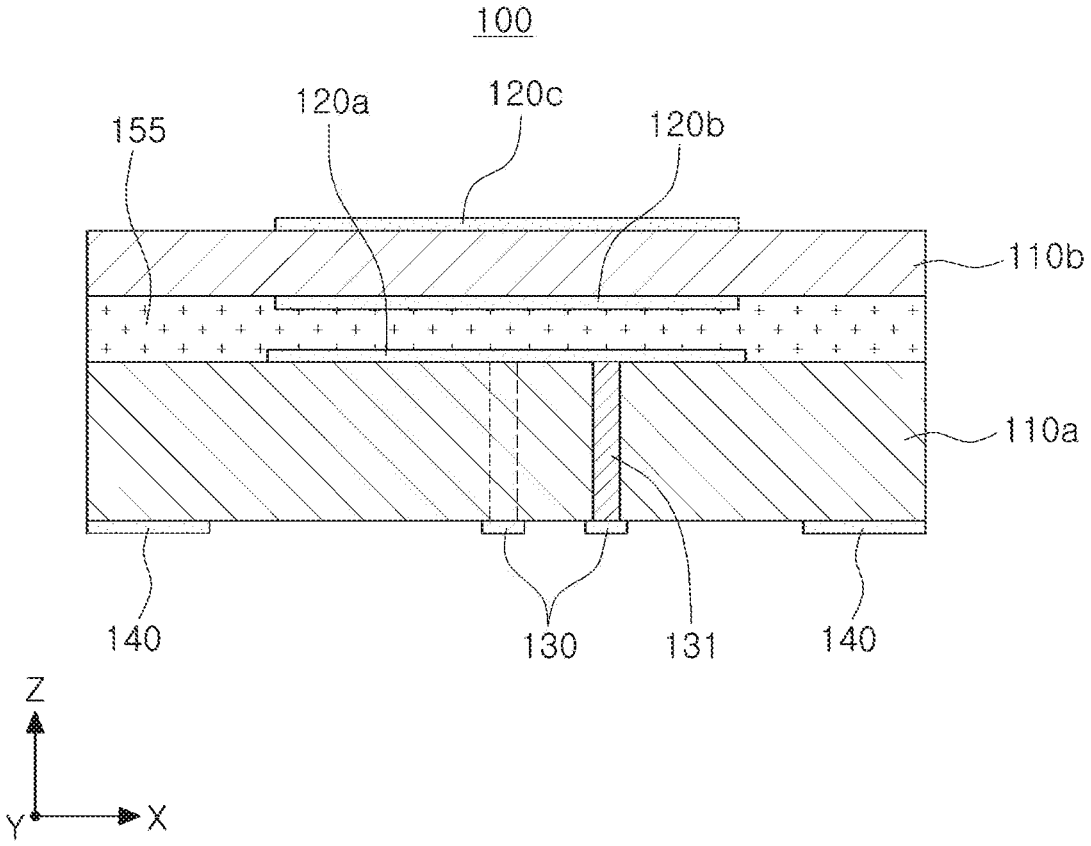
FIG. 6C is a cross-sectional diagram illustrating the chip antenna illustrated in FIG. 6A.

FIG. 6A is a perspective diagram illustrating another example of a chip antenna. FIG. 6B is a side elevation diagram illustrating the chip antenna illustrated in FIG. 6A. FIG. 6C is a cross-sectional diagram illustrating the chip antenna illustrated in FIG. 6A. The chip antenna illustrated in FIGS. 6A to 6C is similar to the chip antenna illustrated in FIGS. 4A to 4C and diagram A of FIG. 4D, and thus overlapping descriptions will not be repeated, and only differences will be described.

In the chip antenna 100 illustrated in FIGS. 4A to 4C and diagram A of FIG. 4D, the first ceramic substrate 110*a* and the second ceramic substrate 110*b* are spaced apart from each other by the spacers 150, but in the chip antenna 100 illustrated in FIGS. 6A to 6C, the first ceramic substrate 110*a* and the second ceramic substrate 110*b* are bonded to each other by a bonding layer 155. The bonding layer 155 is disposed in the gap between the first ceramic substrate 110*a* and the second ceramic substrate 110*b* in the chip antenna module illustrated in FIGS. 4A to 4D.

The bonding layer 155 covers the upper surface of the first ceramic substrate 110*a* and the lower surface of the second ceramic substrate 110*b*, and bonds the first ceramic substrate 110*a* and the second ceramic substrate 110*b* to each other. As an example, the bonding layer 155 may be made of a polymer. As an example, the polymer may be in the form of a polymer sheet. A dielectric constant of the bonding layer 155 is lower than dielectric constants of the first ceramic substrate 110*a* and the second ceramic substrate 110*b*. As an example, a dielectric constant of the bonding layer 155 may be 2 to 3 at 28 GHz, and a thickness of the bonding layer 155 may be 50 to 200 μm.

By making the first ceramic substrate 110*a* and the second ceramic substrate 110*b* of a material having a dielectric constant higher than a dielectric constant of the substrate 10, a size of the chip antenna 100 may be reduced. Also, by disposing the bonding layer 155 having a dielectric constant lower than the dielectric constants of the first ceramic substrate 110*a* and the second ceramic substrate 110*b* between the first ceramic substrate 110*a* and the second ceramic substrate 110*b*, an overall dielectric constant of the chip antenna 100 is reduced, thereby improving a radiation efficiency and a gain of the chip antenna 100.

FIGS. 7A to 7F are diagrams illustrating processes of an example of a method of manufacturing the chip antenna illustrated in FIGS. 6A to 6C. FIGS. 7A to 7F illustrate an example in which a single chip antenna is separately manufactured, but in other examples, a plurality of chip antennas may be manufactured in an integrated form through the manufacturing method illustrated in FIGS. 7A to 7F, and the plurality of chip antennas integrated with one another may be divided into individual chip antennas through a dicing process.

Figure 7C:
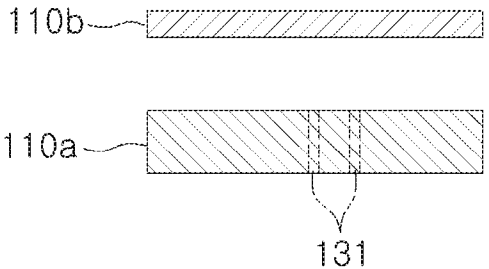
FIGS. 7A to 7F are diagrams illustrating processes of an example of a method of manufacturing the chip antenna illustrated in FIGS. 6A to 6C.
Figure 7B:
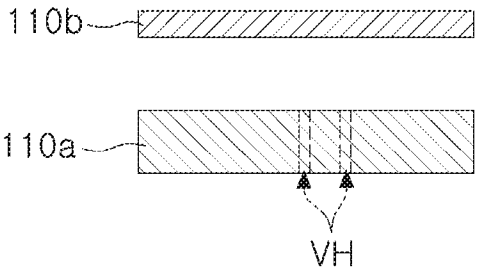
Figure 7A:
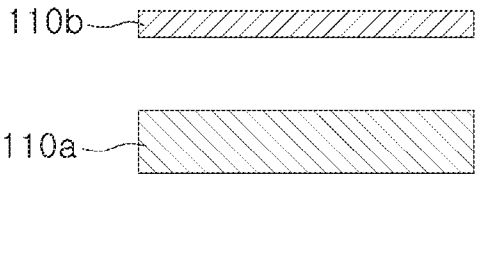

Referring to FIGS. 7A to 7F, a method of manufacturing the chip antenna illustrated in FIGS. 6A to 6C starts with preparing a first ceramic substrate 110*a* and a second ceramic substrate 110*b* (FIG. 7A). Via holes VH penetrating the first ceramic substrate 110*a* in a thickness direction are formed (FIG. 7B), and an internal space of the via holes VH is coated with or filled with a conductive paste to form feed vias 131 (FIG. 7C). The internal space of the via holes VH may be completely filled with the conductive paste, or an internal surface of the via holes VH may be coated with a uniform thickness of the conductive paste.

Figure 7F:
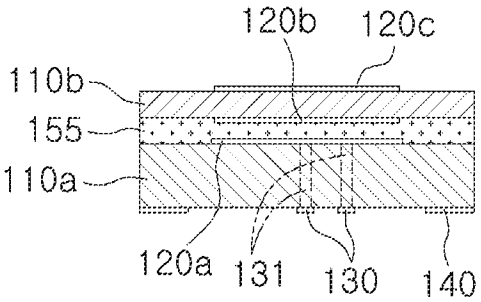
Figure 7E:
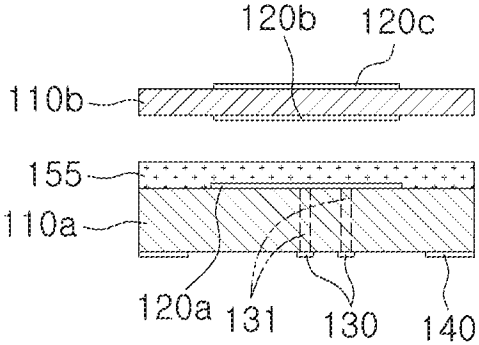
Figure 7D:
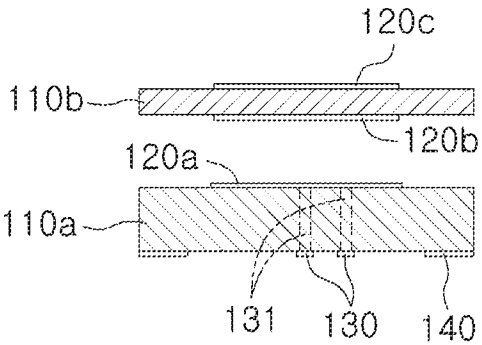

After forming the feed vias, 131, by printing and curing a conductive paste or a conductive epoxy on the first ceramic substrate 110*a* and the second ceramic substrate 110*b*, a first patch 120*a* is formed on the upper surface of the first ceramic substrate 110*a*, feed pads 130 and bonding pads 140 are formed on the lower surface of the first ceramic substrate 110*a*, a second patch 120*b* is formed on the lower surface of the second ceramic substrate 110*b*, and a third patch 120*c* is formed on the upper surface of the second ceramic substrate 110*b* (FIG. 7D). A protective layer (not illustrated) is formed on each of the first patch 120*a*, the second patch 120*b*, the third patch 120*c*, the feed pads 130, the feed vias 131, and the bonding pads 140 through a plating process. The protective layer prevents oxidation of the first patch 120*a*, the second patch 120*b*, the third patch 120*c*, the feed pads 130, the feed vias 131, and the bonding pads 140.

After forming the protective layer, a bonding layer 155 is formed to cover the upper surface of the first ceramic substrate 110*a* including the first patch 120*a* (FIG. 7E). After forming the bonding layer 155, the second ceramic substrate 110*b* is pressed onto the bonding layer 155 formed on the upper surface of the first ceramic substrate 110*a* (FIG. 7F). After the bonding layer 155 has cured, if a plurality of chip antennas integrated with one another have been formed, the plurality of chip antennas integrated with one another are divided through a dicing process, thereby obtaining individual chip antennas.

Figure 8A:
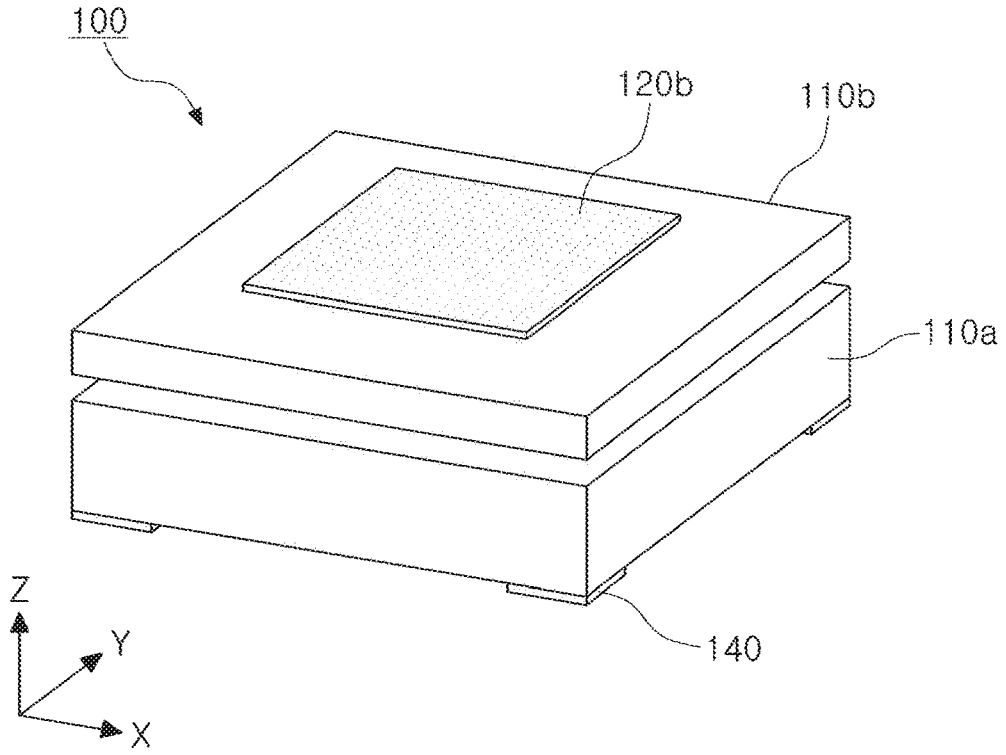
FIG. 8A is a perspective diagram illustrating another example of a chip antenna.
Figure 8B:
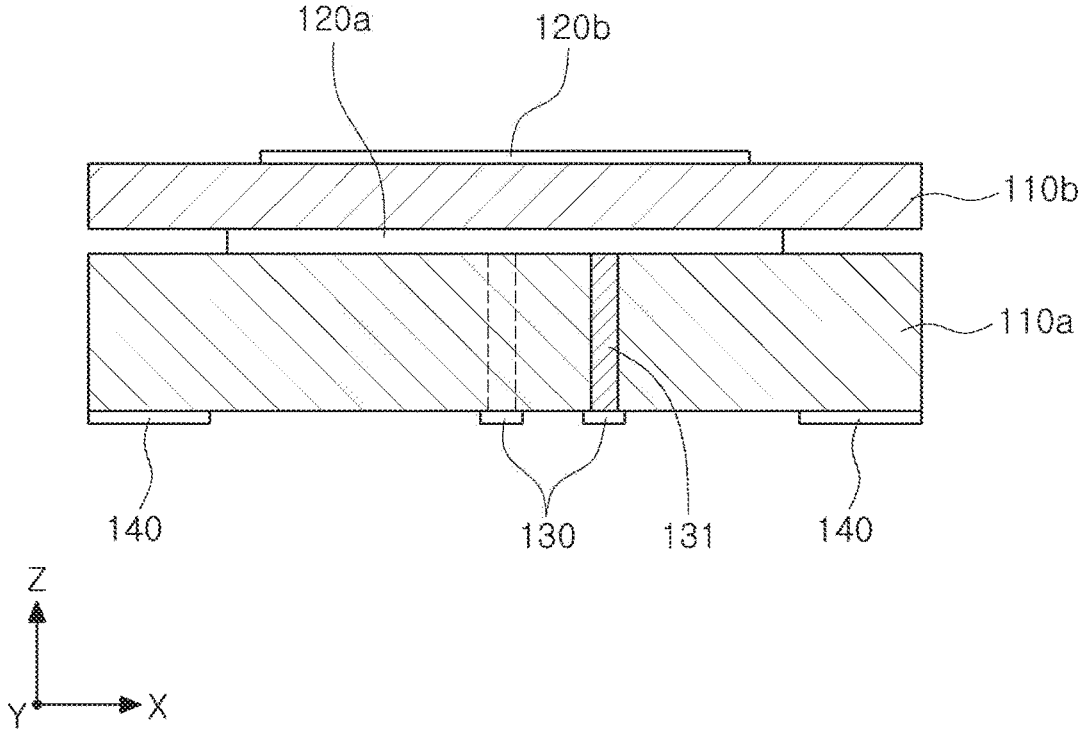
FIG. 8B is a cross-sectional diagram illustrating the chip antenna illustrated in FIG. 8A.

FIG. 8A is a perspective diagram illustrating another example of a chip antenna. FIG. 8B is a cross-sectional diagram illustrating the chip antenna illustrated in FIG. 8A. The chip antenna illustrated in FIGS. 8A and 8B is similar to the chip antenna illustrated in FIGS. 4A to 4C and diagram A of FIG. 4D, and thus overlapping descriptions will not be repeated, and only differences will be described.

In the chip antenna 100 illustrated in FIGS. 4A to 4C and diagram A of FIG. 4D, the first ceramic substrate 110*a* and the second ceramic substrate 110*b* are spaced apart from each other by the spacers 150, but in the chip antenna 100 illustrated in FIGS. 8A and 8B, the first ceramic substrate 110*a* and the second ceramic substrate 110*b* are bonded to a first patch 120*a* interposed between the first ceramic substrate 110*a* and the second ceramic substrate 110*b*.

The first patch 120*a* is disposed on the upper surface of the first ceramic substrate 110*a*, and a second patch 120*b* is disposed on the upper surface of the second ceramic substrate 110*b*. The upper surface of the first patch 120*a* disposed on the upper surface of the first ceramic substrate 110*a* is bonded to the lower surface of the second ceramic substrate 110*b*. Accordingly, the first patch 120*a* is interposed between the first ceramic substrate 110*a* and the second ceramic substrate 110*b*.

FIGS. 9A to 9E are diagrams illustrating processes of an example of a method of manufacturing the chip antenna illustrated in FIGS. 8A and 8B. FIGS. 9A to 9F illustrate an example in which a single chip antenna is separately manufactured, but in other examples, a plurality of chip antennas may be manufactured in an integrated form through the manufacturing method illustrated in FIGS. 9A to 9F, and the plurality of chip antennas integrated with one another may be divided into individual chip antennas through a dicing process.

Figure 9C:
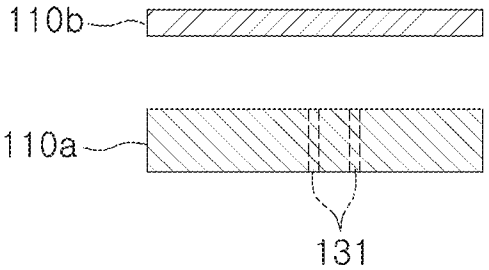
FIGS. 9A to 9E are diagrams illustrating processes of an example of a method of manufacturing the chip antenna illustrated in FIGS. 8A and 8B.
Figure 9B:
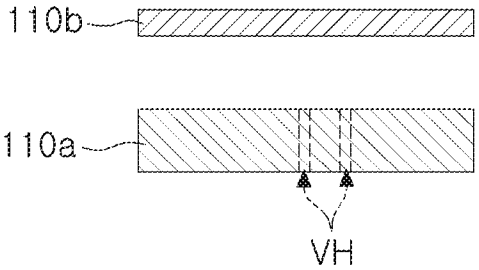
Figure 9A:
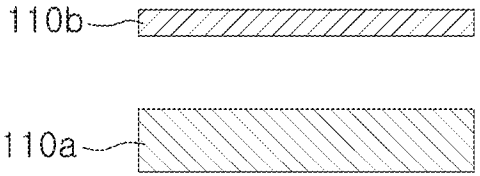

Referring to FIGS. 9A to 9E, a method of manufacturing the chip antenna illustrated in FIGS. 8A and 8B starts with preparing a first ceramic substrate 110*a* and a second ceramic substrate 110*b* (FIG. 9A). Via holes VH penetrating the first ceramic substrate 110*a* in a thickness direction are formed (FIG. 9B), and an internal space of the via holes VH is coated with or filled with a conductive paste to form feed vias 131 (FIG. 9C). The internal space of the via holes VH may be completely filled with the conductive paste, or an internal surface of the via holes VH may be coated with a uniform thickness of the conductive paste.

Figure 9E:
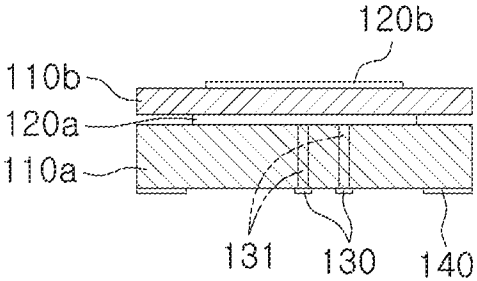
Figure 9D:
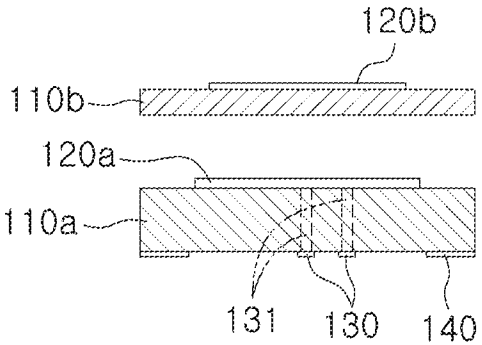

After forming the feed vias 131, by printing and curing a conductive paste or a conductive epoxy on the first ceramic substrate 110*a* and the second ceramic substrate 110*b*, a first patch 120*a* is formed on the surface of the first ceramic substrate 110*a*, feed pads 130 and bonding pads 140 are formed on the lower surface of the first ceramic substrate 110*a*, and a second patch 120*b* is formed on the upper surface of the second ceramic substrate 110*b* (FIG. 9D). Then, a conductive paste or a conductive epoxy (not shown) is printed on an upper surface of the first patch 120*a* one or more times, and the second ceramic substrate 110*b* is pressed onto the conductive paste or the conductive epoxy printed on the upper surface of the first patch 120*a* before the conductive paste or the conductive epoxy printed on the upper surface of the first patch 120*a* has cured (FIG. 9E). After the conductive paste or the conductive epoxy printed on the upper surface of the first patch 120*a* has cured, a protective layer is formed on each of the second patch 120*b*, the feed pads 130, the feed vias 131, and the bonding pads 140 through a plating process. The protective layer prevents oxidation of the second patch 120*b*, the feed pads 130, the feed vias 131, and the bonding pads 140. After the protective layer has been formed, if a plurality of chip antennas integrated with one another have been manufactured, the plurality of chip antennas integrated with one another are divided through a dicing process, thereby obtaining individual chip antennas.

Figure 10:
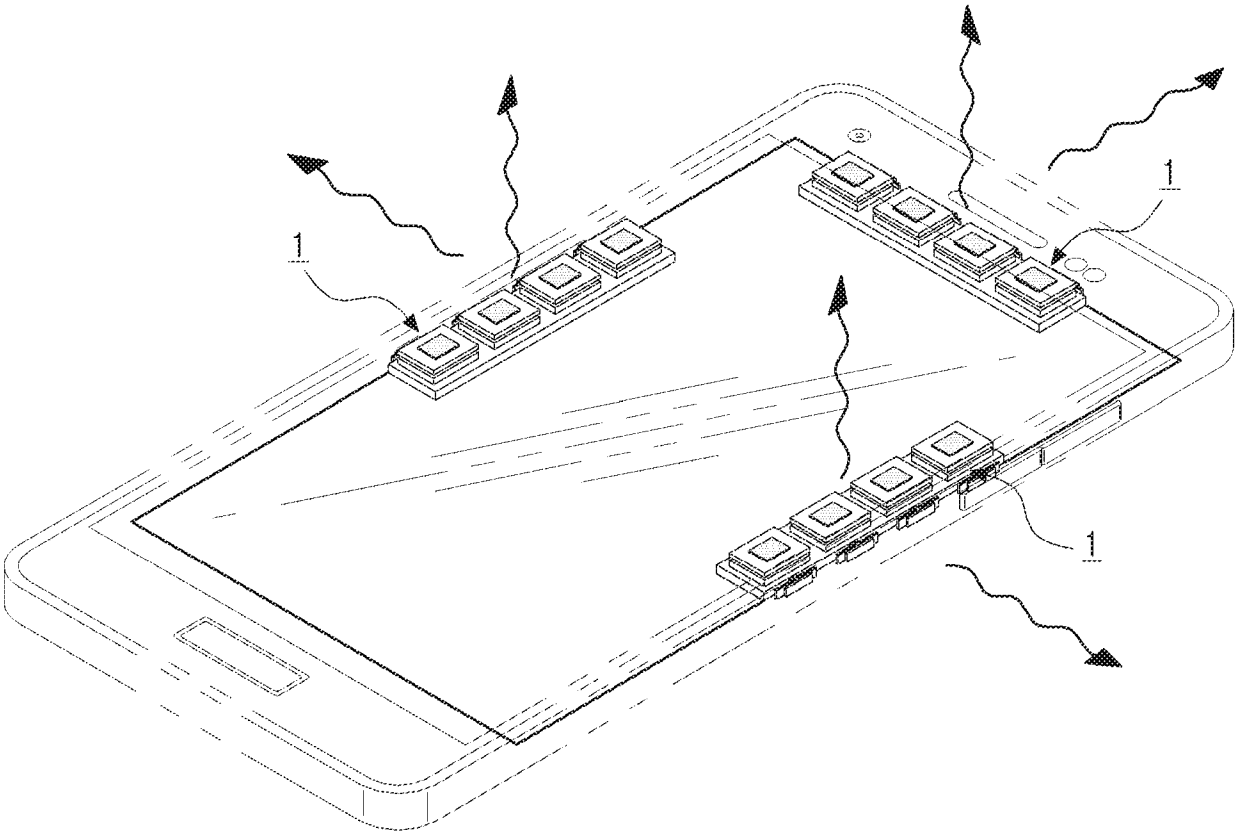
FIG. 10 is a perspective diagram illustrating an example of a mobile terminal device in which a chip antenna module is mounted.

FIG. 10 is a perspective diagram illustrating an example of a mobile terminal device in which a chip antenna module is mounted.

As illustrated in FIG. 10, three chip antenna modules 1 are disposed adjacent to three sides of a portable terminal device having a rectangular shape. In the example illustrated in FIG. 10, the three chip antenna modules are disposed adjacent to both long sides and one short side of the portable terminal device, but the example is not limited thereto. In another example, the three chip antenna modules may be disposed adjacent to both short sides and one long side of the portable terminal device. When an internal space of the portable terminal device is not sufficient to accommodate three chip antenna modules, only two chip antenna modules may be disposed in diagonally opposite corners of the portable terminal device, for example, in an upper left corner and a lower right corner of the portable terminal device, or in an upper right corner and a lower left corner of the portable terminal device. RF signals radiated from the chip antennas of the chip antenna module 1 are radiated in a thickness direction of the portable terminal device, and RF signals radiated from the end-fire antennas of the chip antenna module 1 are radiated in a direction perpendicular to sides of the portable terminal device.

In the examples described above, by implementing a patch antenna as a chip-type patch antenna, rather than as a pattern-type patch antenna implemented by patterns in a multilayer substrate of a chip antenna module, the number of layers in the substrate may be significantly reduced. Accordingly, manufacturing costs and a volume of the chip antenna module may be reduced.

Also, by making dielectric constants of ceramic substrates of the chip antenna higher than a dielectric constant of insulating layers of the substrate, a size of the chip antenna may be reduced.

Further, by spacing the ceramic substrates of the chip antenna apart from each by a certain distance, or by disposing a material having a dielectric constant lower than the dielectric constants of the ceramic substrates between the ceramic substrates, an overall dielectric constant of the chip antenna may be reduced. Accordingly, a size of the chip antenna module may be reduced, and a wavelength of an RF signal transmitted and received by the chip antenna may increase, thereby improving a radiation efficiency and a gain of the chip antenna.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna module comprising:

a substrate comprising:

a plurality of feed pads disposed on a first surface of the substrate; and a plurality of upper surface pads disposed on the first surface of the substrate;

a plurality of chip antennas configured to transmit a radio-frequency signal, electrically connected to the plurality of feed pads, and bonded to the plurality of upper surface pads; and an electronic element mounted on a second surface of the substrate, wherein the substrate further comprises a ground layer configured to reflect the radio-frequency signal transmitted by each of the plurality of chip antennas in a target direction, each of the plurality of chip antennas comprises:

a first ceramic substrate electrically connected to at least one of the plurality of feed pads and bonded to at least one of the plurality of upper surface pads;

a second ceramic substrate opposing the first ceramic substrate;

a first patch disposed on the first ceramic substrate; and a second patch disposed on the second ceramic substrate, and the first ceramic substrate and the second ceramic substrate are spaced apart from each other.

2. The chip antenna module of claim 1, further comprising a spacer disposed between the first ceramic substrate and the second ceramic substrate to space the first ceramic substrate and the second ceramic substrate apart from each other.

3. The chip antenna module of claim 1, further comprising a bonding layer disposed between the first ceramic substrate and the second ceramic substrate to space the first ceramic substrate and the second ceramic substrate apart from each other.

4. The chip antenna module of claim 1, wherein each of the plurality of chip antennas has a width extending in a first direction and a length extending in a second direction perpendicular to the first direction, the plurality of chip antennas are arranged in the second direction, and side surfaces extending in the first direction of two chip antennas adjacent to each other in the second direction among the plurality of chip antennas oppose each other in the second direction.

5. The chip antenna module of claim 4, wherein the plurality of chip antennas are further arranged in the second direction, and side surfaces extending in the second direction of two chip antennas adjacent to each other in the first direction among the plurality of chip antennas oppose each other in the first direction.

6. The chip antenna module of claim 1, wherein each of the plurality of chip antennas is configured to transmit and receive a radio-frequency signal having a wavelength $\lambda$, and a spacing distance between centers of two chip antennas adjacent to each other among the plurality of chip antennas is less than $\lambda/2$.

7. The chip antenna module of claim 1, wherein the ground layer is disposed on the first surface of the substrate.

8. The chip antenna module of claim 7, wherein the ground layer is disposed in a region of the first surface of the substrate other than regions of the first surface of the substrate in which the plurality of feed pads and the plurality of upper surface pads are disposed.

9. The chip antenna module of claim 1, wherein the first ceramic substrate comprises at least one feed via electrically connected to the at least one of the plurality of feed pads and the first patch.

10. A chip antenna module comprising:

a substrate comprising a plurality of layers comprising a first external layer disposed on a first surface of the substrate, a second external layer disposed on a second surface of the substrate, and at least one internal layer disposed between the first external layer and the second external layer; and a plurality of chip antennas disposed on the first surface of the substrate in an array, wherein each of the plurality of chip antennas is configured to transmit a radio-frequency (RF) signal and comprises:

a first ceramic substrate mounted on the first surface of the substrate;

a second ceramic substrate opposing the first ceramic substrate;

a first patch disposed on the first ceramic substrate; and a second patch disposed on the second ceramic substrate, and one layer of the at least one internal layer is a ground layer configured to reflect the RF signal transmitted by each of the plurality of chip antennas in a target direction.

11. The chip antenna module of claim 10, wherein the substrate further comprises a ground via connected to the ground layer, and the ground via extends to the first surface of the substrate from the ground layer.

12. The chip antenna module of claim 11, wherein the ground via is disposed between adjacent chip antennas of the plurality of chip antennas.

13. The chip antenna module of claim 12, wherein the ground via is disposed equidistant from each of the adjacent chip antennas.

14. The chip antenna module of claim 11, wherein the substrate further comprises a shielding wall protruding from the first surface of the substrate between adjacent chip antennas of the plurality of chip antenna.

15. The chip antenna module of claim 14, wherein the substrate further comprises a ground via connected to the ground layer, and the ground via extends from the ground layer into the shielding wall.

16. The chip antenna module of claim 10, wherein the substrate further comprises a plurality of ground vias connected to the ground layer, and the plurality of ground vias extend to the first surface of the substrate from the ground layer.

17. The chip antenna module of claim 16, wherein the plurality of ground vias are disposed between opposing side surfaces of adjacent chip antennas of the plurality of chip antennas.

18. The chip antenna module of claim 10, wherein the first external layer is a ground layer, and is configured to reflect the RF signal transmitted by each of the plurality of chip antennas in a target direction.

19. A chip antenna module comprising:

a substrate;

a chip-type patch antenna spaced apart from an upper surface of the substrate and configured to transmit a radio-frequency (RF) signal in a first direction perpendicular to the upper surface of the substrate; and a chip-type end-fire antenna disposed on the substrate and configured to transmit an RF signal in a second direction parallel to the upper surface of the substrate, wherein the substrate comprises a ground layer disposed inside the substrate and configured to reflect the RF signal transmitted by the chip-type patch antenna in the first direction.

20. The chip antenna module of claim 19, wherein the substrate further comprises a second ground layer disposed on the upper surface of the substrate and configured to reflect the RF signal transmitted by the chip-type patch antenna in the first direction.

21. The chip antenna module of claim 19, wherein the chip-type patch antenna comprises:

a first ceramic substrate spaced apart from the upper surface of the substrate;

a first patch disposed on an upper surface of the first ceramic substrate;

a second ceramic substrate spaced apart from the upper surface of the first ceramic substrate, and a second patch disposed on an upper surface of the second substrate or a lower surface of the second ceramic substrate, and the chip-type end-fire antenna comprises:

a ground portion made of a conductive material;

a body portion made of a dielectric material and disposed on a surface of the ground portion facing in the second direction; and a radiation portion made of a conductive material and disposed on a surface of the body portion facing in the second direction.

* * * * *